US009962666B2

(12) United States Patent
Enomura

(10) Patent No.: US 9,962,666 B2
(45) Date of Patent: May 8, 2018

(54) STIRRER

(75) Inventor: Masakazu Enomura, Izumi (JP)

(73) Assignee: M. TECHNIQUE CO., LTD., Izumi-Shi, Osaka (JP)

( * ) Notice: Subject to any disclaimer, the term of this patent is extended or adjusted under 35 U.S.C. 154(b) by 500 days.

(21) Appl. No.: 14/409,977

(22) PCT Filed: Jul. 13, 2012

(86) PCT No.: PCT/JP2012/068028
§ 371 (c)(1),
(2), (4) Date: Dec. 19, 2014

(87) PCT Pub. No.: WO2014/010094
PCT Pub. Date: Jan. 16, 2014

(65) Prior Publication Data

US 2015/0321154 A1 Nov. 12, 2015

(51) Int. Cl.
*B01F 7/00* (2006.01)
*B01F 7/16* (2006.01)
(Continued)

(52) U.S. Cl.
CPC ..... *B01F 7/1675* (2013.01); *B01F 3/0807* (2013.01); *B01F 5/0662* (2013.01);
(Continued)

(58) Field of Classification Search
CPC .... B01F 7/1675; B01F 7/168; B01F 7/00408; B01F 7/00416; B01F 7/00641;
(Continued)

(56) References Cited

U.S. PATENT DOCUMENTS 3,299,924 A * 1/1967 Hanschitz ..... A47J 43/044 241/282.2
6,830,700 B1 * 12/2004 Kitchen ..... B01D 21/0033 148/212
(Continued)

FOREIGN PATENT DOCUMENTS

CN 1318426 A 10/2001
CN 102768481 A 11/2012
(Continued)

*Primary Examiner* — Anshu Bhatia
(74) *Attorney, Agent, or Firm* — Birch, Stewart, Kolasch & Birch, LLP

(57) ABSTRACT

A stirrer is capable of finely dispersing or emulsifying well. A stirrer in which: the stirrer is provided with a rotating rotor equipped with multiple blades and a screen that is placed around the rotor and has multiple slits; the blade and the slits are provided at least with matching regions that are at the same position in the axial direction of the rotor rotation axis; and the fluid being processed is discharged outward from inside the screen as an intermittent jet flow through the slits as a result of the rotation of the rotor. The stirrer is characterized in that when the maximum external diameter of the rotor in the matching region is (D) (m), the rotation frequency of the rotor (2) is (N) (times/s), the number (12) is (X) and the number of slits (8) is (Y), the circumferential velocity (V) (m/s) of the rotor (2) rotation is represented by equation (1) and the frequency (Z) (kHz) of the intermittent jet flow is represented by equation (2)(V)=(D)×(π)×(N)(1) (Z)=(N)×(X)×(Y)/1000(2) and the circumferential velocity (V) is set to be 23 m/s<(V)<37 m/s and the frequency (Z) is set to be 35<(Z).

15 Claims, 19 Drawing Sheets

(51) Int. Cl.
*B01F 3/08* (2006.01)
*B01F 5/06* (2006.01)
*B01F 5/10* (2006.01)

(52) U.S. Cl.
CPC ..... *B01F 5/10* (2013.01); *B01F 7/00408* (2013.01); *B01F 7/00416* (2013.01); *B01F 7/00641* (2013.01); *B01F 7/162* (2013.01); *B01F 7/166* (2013.01); *B01F 7/1635* (2013.01); *B01F 2215/0409* (2013.01); *B01F 2215/0454* (2013.01); *B01F 2215/0481* (2013.01)

(58) Field of Classification Search
CPC ..... B01F 7/162; B01F 7/166; B01F 3/0807; B01F 5/0662; B01F 5/10; B01F 2215/0409; B01F 2215/0454; B01F 2215/0481; A47J 43/044; A47J 2043/04409
See application file for complete search history.

(56) References Cited

U.S. PATENT DOCUMENTS

| | | | | |
|---|---|---|---|---|
| 2007/0128537 | A1* | 6/2007 | Ariyoshi ..... | G03G 9/0804 430/137.1 |
| 2012/0282000 | A1 | 11/2012 | Nakayama et al. | |
| 2013/0215711 | A1 | 8/2013 | Kamiya | |
| 2014/0113852 | A1 | 4/2014 | Bongers et al. | |

FOREIGN PATENT DOCUMENTS

| | | | |
|---|---|---|---|
| CN | 103459008 | A | 12/2013 |
| JP | 4-114724 | A | 4/1992 |
| JP | 7-96167 | A | 4/1995 |
| JP | 2813673 | B2 | 10/1998 |
| JP | 312556 | B2 | 1/2001 |
| JP | 2003-5453 | A | 1/2003 |
| JP | 2007-21285 | A | 2/2007 |
| JP | 2007-156008 | A | 6/2007 |
| WO | WO 2012/023609 | A1 | 2/2012 |

* cited by examiner (A)

(B)

STIRRER

TECHNICAL FILED

The present invention relates to a stirrer, especially relates to improvement of a stirrer to be used for emulsification, dispersion, or mixing of a fluid to be processed.

BACKGROUND ART

Various stirrers have been proposed for emulsification, dispersion, or mixing of a fluid, and today it is requested that a fluid to be processed which contains a material having a small particle diameter such as a nanoparticle is processed sufficiently well.

For example, a bead mill and a homogenizer are known as examples among many stirrers widely known.

In a bead mill, however, performance deterioration due to destruction and damage of a crystal condition of particle's surface has been a problem. Another significant problem is that a foreign matter is generated. In a high pressure homogenizer, problems relating to stable operation and requirement of a significantly large energy are yet to be solved.

A rotary homogenizer has been used as a pre-mixer in the past; but this requires a finishing machine to accomplish dispersion and emulsification to a nanometer level.

In view of the above situation, inventors of the present invention proposed the stirrer shown in Patent Documents 1 and 2. This stirrer is equipped with a rotor having plural blades and a screen having plural slits which is arranged around the rotor. The rotor and the screen rotate relative to each other, whereby shearing a fluid to be processed in a very narrow space formed between the blades and the inner wall of the screen which has slits so that the fluid to be processed is discharged from inside the screen toward outside thereof through the slits as an intermittent jet flow.

In the stirrer like this, as shown in the columns of Background Art of Patent Document 2, the stirring condition thereof has been changed by adjusting the rotation number of the impeller (namely the rotor).

There, it is described, "For example, to consider the case of emulsification, by rotation of the impeller, a fluid is sheared between the inner wall arranged with a discharged part of the stirring chamber and the impeller's edge whereby emulsifying one fluid into the other fluid.

Meanwhile, the emulsification capacity of one particular equipment changes depending on properties of fluids to be processed as well as on a combination of the plural fluids; and therefore, the optimum condition for emulsification capacity needs to be obtained in advance in accordance with the fluid to be processed whereby conforming the equipment to this condition.

In the past, the adjustment has been made by arbitrary setting the impeller's rotation number to secure the maximum point of the emulsification capacity.

This is based on the fact that the elements to determine the emulsification capacity are given by the following parameters.

That is, the processing capacity has been evaluated by values of a shear strength, an energy amount, and a passing number. This shear strength (S) is the value showing the strength of the shear force between the impeller and the inner wall of the stirring chamber, and this can be given by the following equation.

$$S=Ns\cdot v=Ns\cdot\pi\cdot d\cdot n$$

Next, the energy amount (Pv), which is the stirring energy per unit processing quantity, can be given by the following equation.

$$Pv=(P/V)\times T=(Np\cdot\rho\cdot n^3\cdot d^5/V)\times T \quad \text{[Eq. 1]}$$

Then, the passing number (Pn), which is the passing number showing how many times the fluid goes through between the impeller and the inner wall of the stirring chamber, namely the circulation number, can be given by the following equation.

$$Pn=(Q/V)\times T=(Nq\cdot n\cdot d^3/V)\times T \quad \text{[Eq. 2]}$$

Here, v is the maximum circumferential velocity of the impeller (m/sec), d is the diameter of the impeller (m), and n is the rotation number of the impeller (rps). Further, P is the required stirring energy (kw), Np is the power number, Nq is the discharged coefficient. Further, Q is the discharged amount ($m^3$/sec), Ns is the shear coefficient, and V is the processing amount ($m^3$).

Further, T is the processing time (sec) and ρ is the specific gravity (kg/$m^3$) inherent to the fluid to be processed.

As it can be seen clearly from the above equations, the stirring condition has been changed by adjusting the rotation number (n) of the impeller."

In the invention according to Patent Document 2, the proposal was made as to the stirrer in which the clearance between the edge of the impeller and the inner wall of the screen can be selected arbitrarily while not only the rotation number of the impeller is controlled but also the necessary energy for processing by stirring and so forth is kept constant, whereby intending to optimize the capacity improvement in accordance with the fluid to be processed.

Further finer microparticles with more uniform particle diameter distribution are required in the fields using microparticles such as chemistry, electric and electronics, motor vehicles, foods, color materials, and pharmaceutical drugs; however, by conventional stirrers having the performances so far disclosed, it has been difficult to achieve emulsification and dispersion with which fine microparticles having the uniform particle diameter distribution can be obtained.

Accordingly, even today the above mentioned high-pressure homogenizer and bead mill are used mainly in most cases in emulsification and dispersion; and thus, problems of the energy cost and contamination by a foreign matter have not been solved yet, and on top of that, naturally the producing process using these equipment tends to become complex.

In Patent Documents 1 and 2 which were filed by the applicant of the present invention, disclosed are the effect of the shear force due to the rotor and the screen and the effect of the intermittent jet flow discharged from the screen. A standard model of the stirrer manufactured and marketed by the present applicant based on these effects is the experimental type having the rotor diameter of 30 mm as the minimum scale. In this model, as the maximum, number of the blades is four, number of the slits formed in the screen is 24, and the rotation number is 21,500 rpm; however, in the model like this, it has been difficult to obtain 35 or more as the frequency Z (kHz) of the intermittent jet flow. The rotation number might be increased further up if so desired; however this caused such problems that it increased the loads to the motor and to the equipment and that it tended to readily increase the energy cost. The same was true for the case that up-scaling was made by increasing the rotor diameter; in this case, although number of the slits of the screen could be increased, because the rotation number was decreased and for other reasons, naturally the frequency Z (kHz) of the intermittent jet flow was less than 35. Therefore, sufficient information has not been obtained yet as to the emulsification and dispersion with the frequency Z of 35 or more.

PRIOR ART DOCUMENTS

Patent Document

Patent Document 1: Japanese Patent No. 2813673.
Patent Document 2: Japanese Patent No. 3123556.

DISCLOSURE OF THE INVENTION

Problems to be Solved by the Invention

The present invention has an object to provide a stirrer with which extremely fine dispersion and emulsification such as nano-dispersion and nano-emulsification can be realized successfully.

Means for Solving the Problems

When inventors of the present invention attempted to increase the frequency Z (kHz) of the intermittent jet flow above 35, it was found that the effect to make particles finer was drastically enhanced; and based on this finding, the invention could be completed as to the stirrer that enabled to make the particles finer in the region which could not be achieved by conventional stirrers.

That is, the present invention provides a stirrer, comprising:

a rotating rotor which is equipped with plural blades and a screen having plural slits which is arranged around the rotor, in which the blades and the slits have at least a matching region between them in the same position in the axial direction of the rotation axis of the rotor, and a fluid to be processed is discharged as an intermittent jet flow through the slits from inside the screen to outside the screen by rotating the rotor; wherein if maximum outer diameter of the rotor in the matching region is shown by D (m), number of rotation of the rotor is shown by N (revolutions/sec), number of the blades is shown by X, number of the slits is shown by Y, circumferential velocity V (m/sec) of rotation of the rotor is shown by the equation (1), and frequency Z (kHz) of the intermittent jet flow is shown by the equation (2), then the circumferential velocity V is set so as to be larger than 23 m/sec and smaller than 37 m/sec, and the frequency Z is set so as to be more than 35.

$$V=D\times\pi\times N \quad (1)$$

$$Z=N\times X\times Y\div 1000 \quad (2)$$

In this case, the frequency Z may be set at less than 92.

In this case, an embodiment wherein the screen does not rotate may be possible.

Further, in the case that the screen is made to rotate at the rotation speed which is as high as that of the rotor, it is desirable to follow the following conditions.

That is, in a stirrer in which the rotor and the screen are made to rotate in the opposite direction with each other whereby discharging the fluid to be processed as the intermittent jet flow from inside the screen toward outside thereof through the slits, wherein if maximum outer diameter of the rotor in the matching region is shown by D (m), number of rotation of the rotor is shown by N1, number of rotation of the screen is shown by N2, relative rotation number of the rotor and the screen is shown by N (revolutions/sec), number of the blades is shown by X, number of the slits is shown by Y, circumferential velocity V (m/sec) of relative rotation of the rotor to the screen is shown by the equation (1), and frequency Z (kHz) of the intermittent jet flow is shown by the equation (2), then the circumferential velocity V is set so as to be larger than 48 m/sec and smaller than 85 m/sec, and the frequency Z is set so as to be more than 65.

$$V=D\times\pi\times N(\text{however},N=N1+N2) \quad (1)$$

$$Z=N\times X\times Y\div 1000 \quad (2)$$

In this case, the frequency Z may be set at less than 185.

Further, desirably the present invention is executed such that diameters of the blades and of the screen may become smaller as departing from an introduction part through which the fluid to be processed is introduced into the screen toward outside in the axial direction.

Advantages

According to the present invention, it became possible to provide a stirrer which can drastically realize a large effect to make particles finer by increasing the frequency Z (kHz) of the intermittent jet flow to above 35, and also, by increasing Z to above 65 when both the rotor and the screen are rotated.

As shown in Examples described later, to inventors' surprises, in the stage when the frequency Z became 40 (or 68) or more after the frequency Z went over 35 (or 65), it was confirmed that the particle diameter of the intended particles obtained by the emulsification and dispersion treatment could be made smaller drastically, and that the variance indicator C. V. value of the particle diameter became smaller drastically.

This phenomenon cannot be explained merely by increase of the rotation number, but this may be related to the following actions though the mechanism thereof has not been fully understood yet. That is, in the stirrer of this kind, increase/decrease of the pressure to the fluid take place whereby generating the intermittent jet flow; and as a result, it is thought that this influences pulverization of the particles, so that in the stage when the frequency Z becomes 40 (or 68) or more after the frequency Z goes over 35 (or 65), the action of increase/decrease of the pressure, the liquid-liquid shear force generated in the velocity interface of the jet flow, and the action of the shear force to the fluid to be processed between the blades 12 and the inner circumferential surface of the screen 9 can work much more effectively to the particles.

Figure 1:
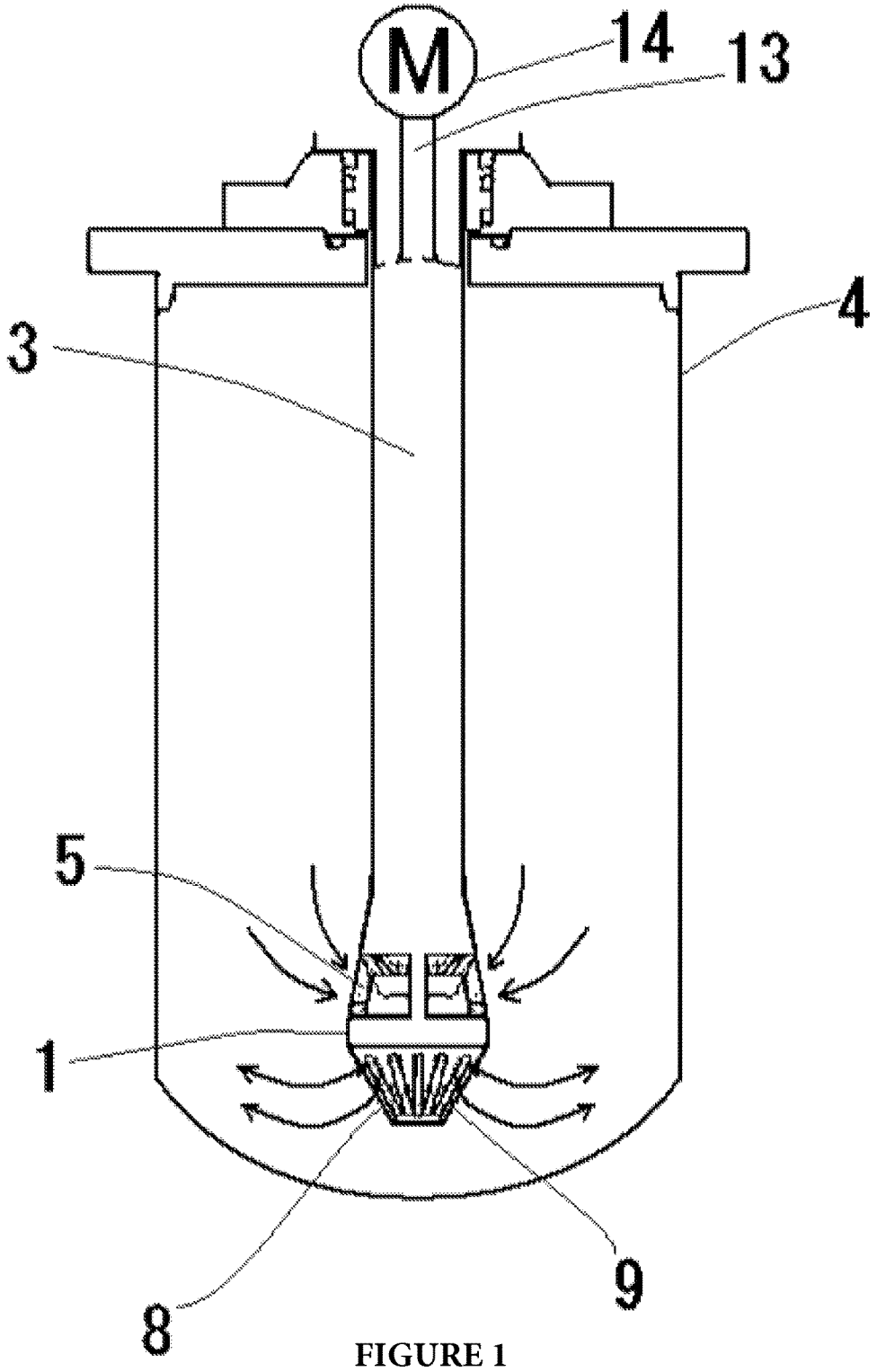
FIG. 1

This is the front view showing the state how the stirrer of the first embodiment of the present invention is used.

FIG. 2

This is the enlarged vertical sectional view of the essential part of the said stirrer.

FIG. 3

This is the enlarged transverse sectional view of the essential part of the screen of the said stirrer.

FIG. 4

This is the enlarged transverse sectional view of the essential part of one example of the modified screen of the said stirrer.

FIG. 5

This is the enlarged transverse sectional view of the essential part of the screen and the rotor of the said stirrer.

FIG. 6

This is the enlarged transverse sectional view of the essential part of one example of the modified screen and rotor of the said stirrer.

FIG. 7

This is the front view showing the state how one example of the modified stirrer of the first embodiment of the present invention is used.

FIG. 8

This is the front view showing the state how another example of the modified stirrer of the first embodiment of the present invention is used.

FIG. 9

This is the front view showing the state how the stirrer of the second embodiment of the present invention is used.

FIG. 10

(A) The flow diagram of Examples 1 to 3 and 7 and Comparative Example 1 is shown.

(B) The flow diagram of Examples 4 to 6 and Comparative Example 2 is shown.

FIG. 11

This is the graph showing D50 and C. V. value of the emulsified particles of Example 1 relative to the frequency Z of the intermittent jet flow obtained from the particle diameter measurement results.

FIG. 12

This is the graph showing D50 and C. V. value of the emulsified particles of Example 2 relative to the frequency Z of the intermittent jet flow obtained from the particle diameter measurement results.

FIG. 13

This is the graph showing D50 and C. V. value of the emulsified particles of Example 3 relative to the frequency Z of the intermittent jet flow obtained from the particle diameter measurement results.

FIG. 14

This is the graph showing D50 and C. V. value of the emulsified particles of Comparative Example 1 relative to the frequency Z of the intermittent jet flow obtained from the particle diameter measurement results.

FIG. 15

This is the graph showing D50 and C. V. value of the emulsified particles of Example 4 relative to the frequency Z of the intermittent jet flow obtained from the particle diameter measurement results.

FIG. 16

This is the graph showing D50 and C. V. value of the emulsified particles of Example 5 relative to the frequency Z of the intermittent jet flow obtained from the particle diameter measurement results.

FIG. 17

This is the graph showing D50 and C. V. value of the emulsified particles of Example 6 relative to the frequency Z of the intermittent jet flow obtained from the particle diameter measurement results.

FIG. 18

This is the graph showing D50 and C. V. value of the emulsified particles of Comparative Example 2 relative to the frequency Z of the intermittent jet flow obtained from the particle diameter measurement results.

FIG. 19

This is the graph showing D50 and C. V. value of the emulsified particles of Example 7 relative to the frequency Z of the intermittent jet flow obtained from the particle diameter measurement results.

BEST MODES FOR CARRYING OUT THE INVENTION

Hereunder, the first embodiment of the present invention will be explained based on the drawings.

Figure 2:
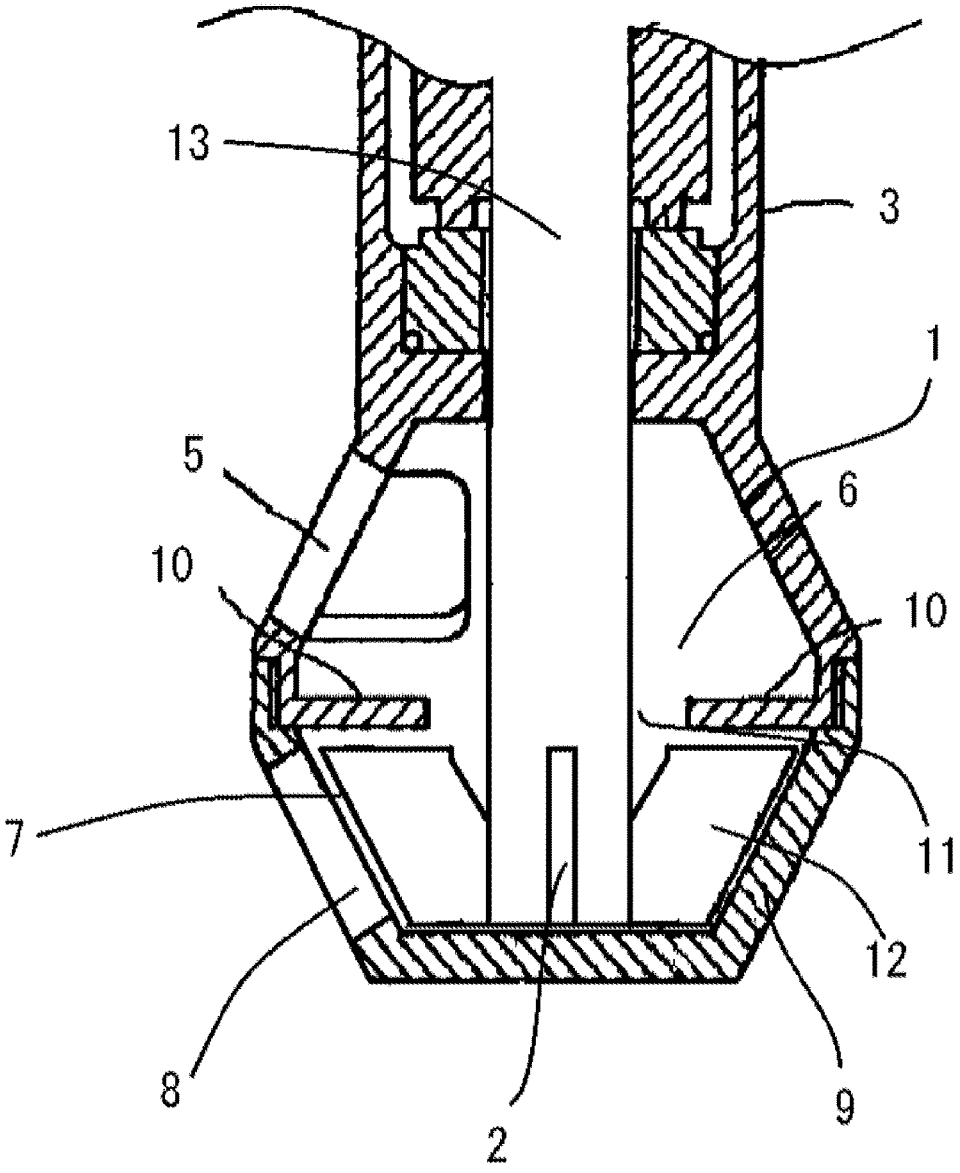

As shown in FIG. 1 and FIG. 2, the stirrer according to this embodiment comprises the processing member 1 disposed in the fluid that will be subjected to the processing treatment such as emulsification, dispersion, and mixing and the rotor 2 disposed in the processing member 1.

Figure 7:
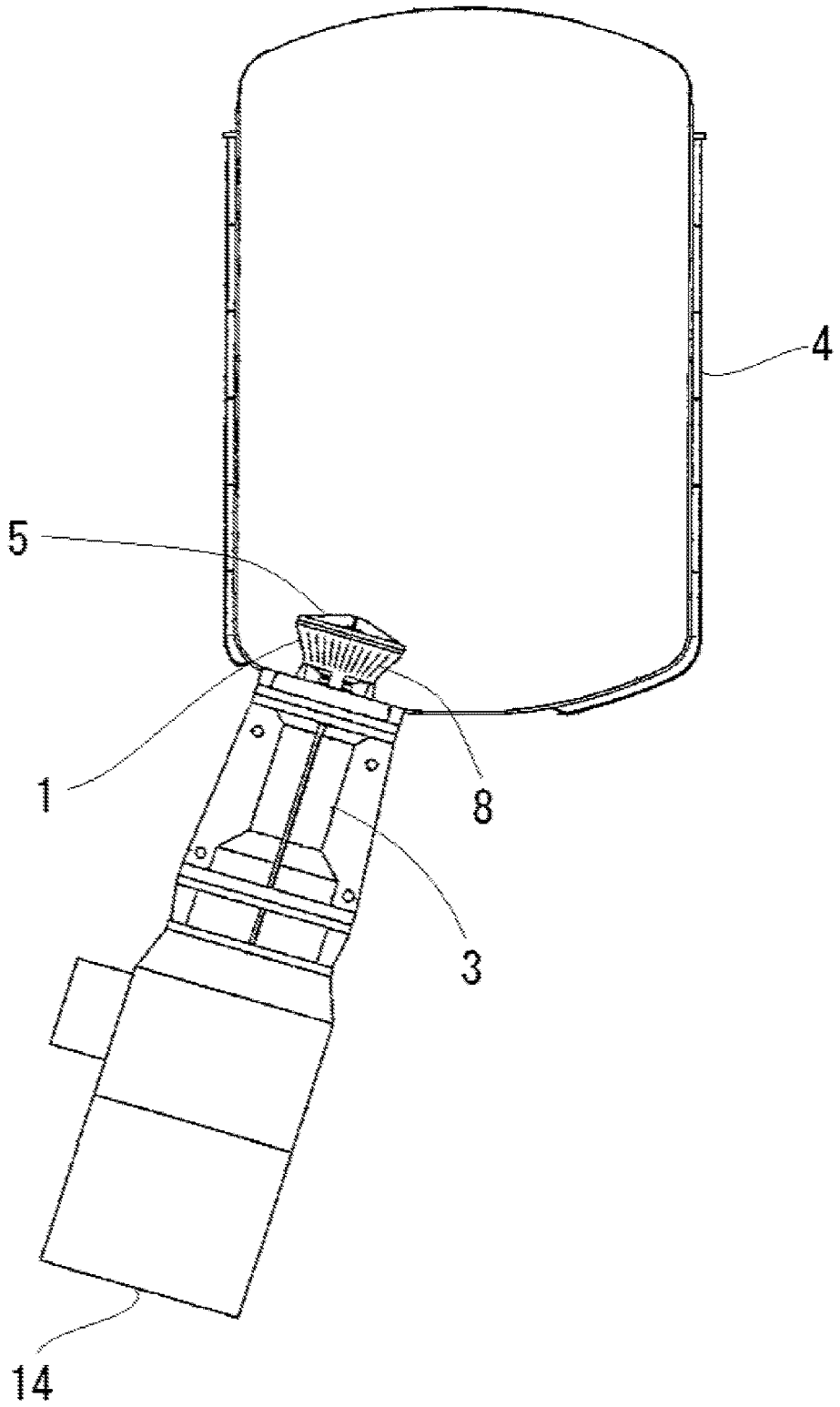

The processing member 1 is a hollow housing, which is supported by the supporting tube 3 and is arranged either in the accommodating vessel 4 in which the fluid to be processed is accommodated or in the flow path of the fluid to be processed. In this embodiment, it is shown that the processing member 1 is arranged in the front end of the supporting tube 3 and is inserted from the upper side of the accommodating vessel 4 into the lower side therein; however this is not always the case, so that execution of the embodiment may also be possible in such a way that the processing member 1 may be supported by the supporting tube 3 so as to be projected from the bottom of the accommodating vessel 4 toward the upper direction thereof, as shown in FIG. 7.

The processing member 1 comprises the sucking chamber 6 having the sucking port 5 through which the fluid to be processed is sucked into inside the chamber from the outside thereof, and the stirring chamber 7 that is connected through to the sucking chamber 6. The circumference of the stirring chamber 7 is stipulated by the screen 9 that has plural slits 8.

Between the sucking chamber 6 and the stirring chamber 7 is comparted by the comparting wall 10, and these compartments are connected through via the introduction opening 11 that is arranged in the comparting wall 10. However, the sucking chamber 6 and the comparting wall 10 are not essential; and thus, for example, the entirety of the upper part of the stirring chamber 7 may be the introduction opening without arranging the sucking chamber 6 whereby introducing the fluid to be processed in the accommodating vessel 4 directly into the stirring chamber 7, or alternatively the sucking chamber 6 and the stirring chamber 7 may form a configuration of one space in which these chambers are not comparted by the comparting wall 10.

The rotor 2 is a rotating body having plural blades 12 in the circumferential direction; and this rotates with keeping a very narrow clearance between the blades 12 and the screen 9. As to the mechanism to rotate the rotor 2, various rotation drive mechanisms may be used; and in this embodiment, the rotor 2 is arranged in the front end of the rotation axis 13, and this is accommodated in the stirring chamber 7 so as to be able to rotate. In more detail, the rotation axis 13 is inserted through the supporting tube 3 so as to go through the sucking chamber 6 and the opening 11 of the comparting wall 10 until the stirring chamber 7, and is provided with the rotor 2 in its front end (in the drawing, the lower end). The rear end of the rotation axis 13 is connected to the rotation drive mechanism such as the motor 14. The motor 14 is preferably subjected to the control of the control system such as the numerical control or a computer.

In this stirrer, during the time when the rotating blades 12 are passing the inner wall of the screen 9 by rotation of the rotor 2, a shear force is applied to the fluid to be processed that is present between the blades and the wall whereby executing emulsification, dispersion, or mixing. At the same time with this, by rotation of the rotor 2, the kinetic energy is given to the fluid to be processed thereby accelerating the fluid to be processed while it is passing through the slits 8; and as a result, the fluid to be processed is discharged to outside the stirring chamber 7 while forming the intermittent jet flow. By this intermittent jet flow, the liquid-liquid shear force is also generated in the velocity interface whereby executing emulsification, dispersion, or mixing.

Figure 3:
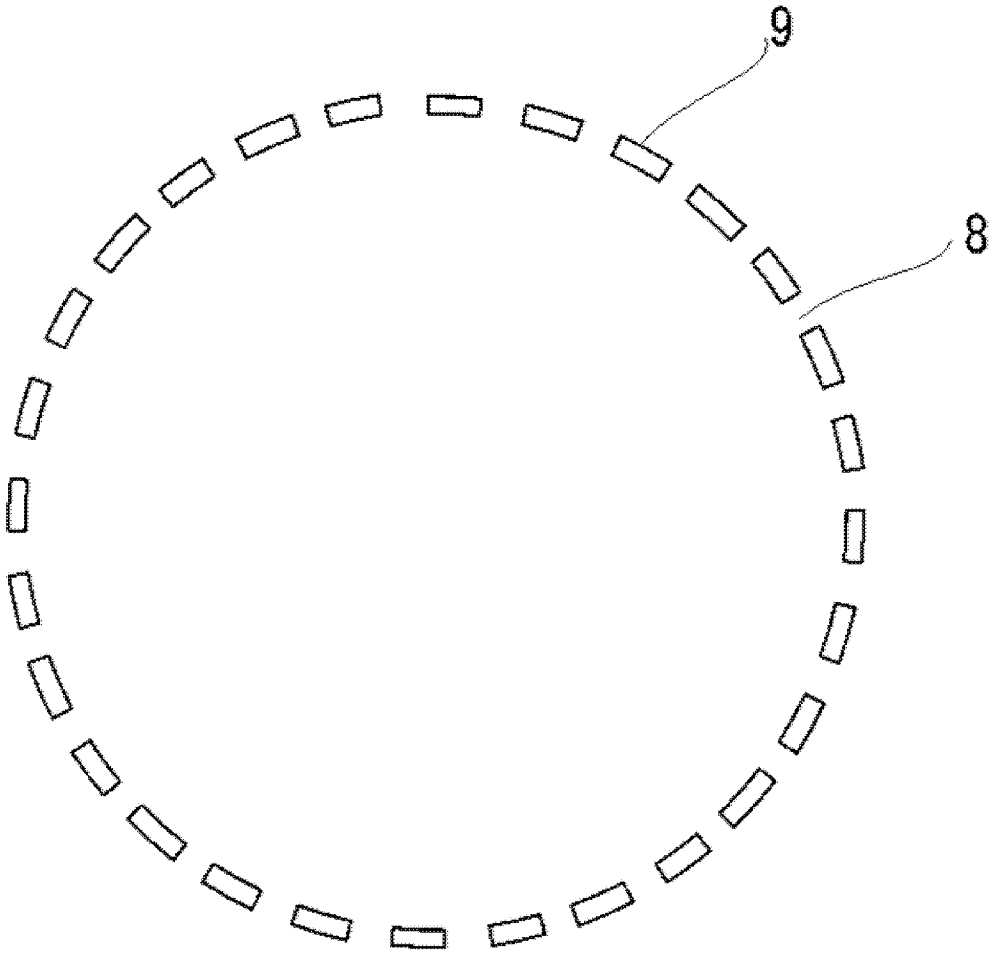
Figure 4:
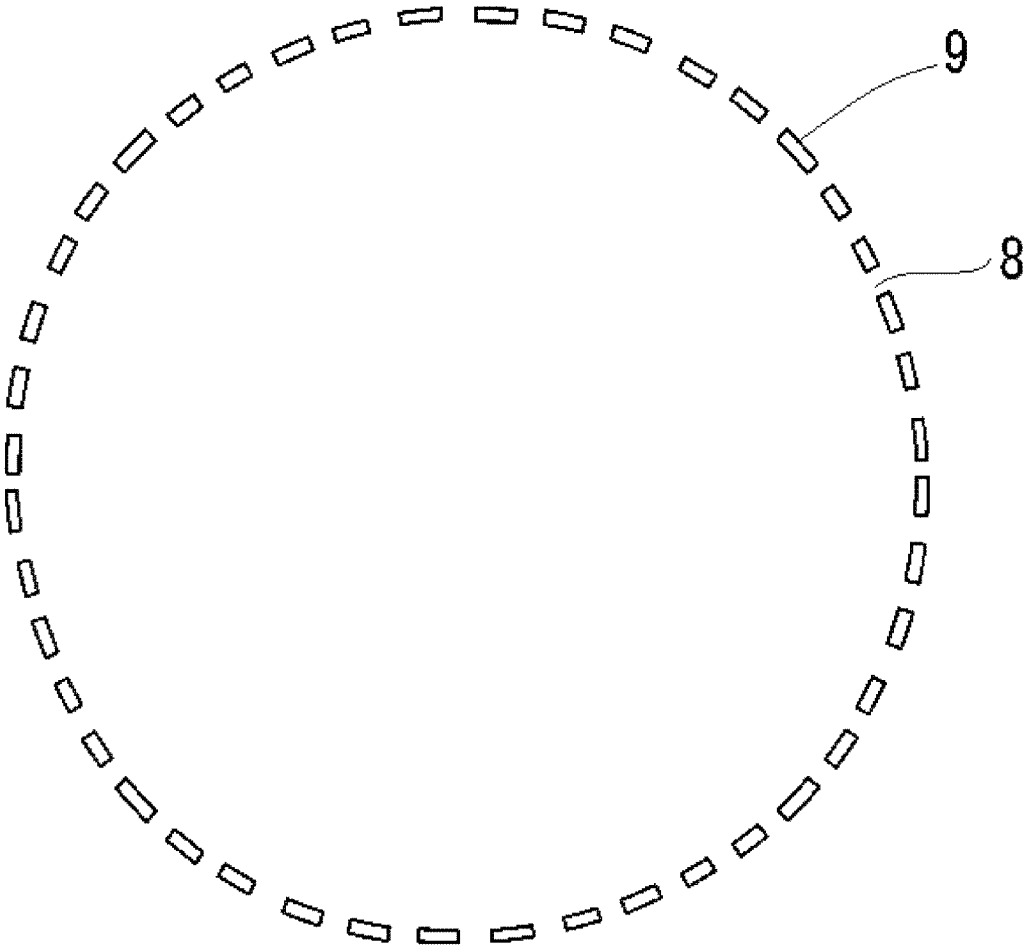

The screen 9 has a form of cylinder having a circular cross section as shown in FIG. 3 and FIG. 4. This screen 9 may be a form of the cylinder whose diameter is constant in the axial direction; however, it is preferable that the diameter thereof become smaller as departing from the introduction opening 11 (in the example of FIG. 2, as departing toward the lower end) whereby forming the shape appeared like a conical form. If the diameter is made constant in the axial direction, the discharged amount from the slits 8 is larger in the part near to the introduction opening 11 (in FIG. 2, in the upper part), whereas the discharged amount is smaller in the part apart far from the opening (in FIG. 2, in the lower part). As a result, there is a risk of generating the uncontrollable cavitation which may cause a mechanical malfunction.

The slits 8 that are extended linearly to the direction of the rotation axis 13 (vertical direction in the example of the drawing) are shown; however, they may be extended spirally or warpingly. The shape of the slits 8 is not necessarily a narrow and long space; they may be in the shape of polygonal, circular, ellipse, or the like. In addition, although the slits 8 are formed in plural with the same intervals in the circumferential direction; however, they may be formed with putting off in the intervals, and besides, the slits 8 having plural shapes and sizes may not be excluded.

Figure 5:
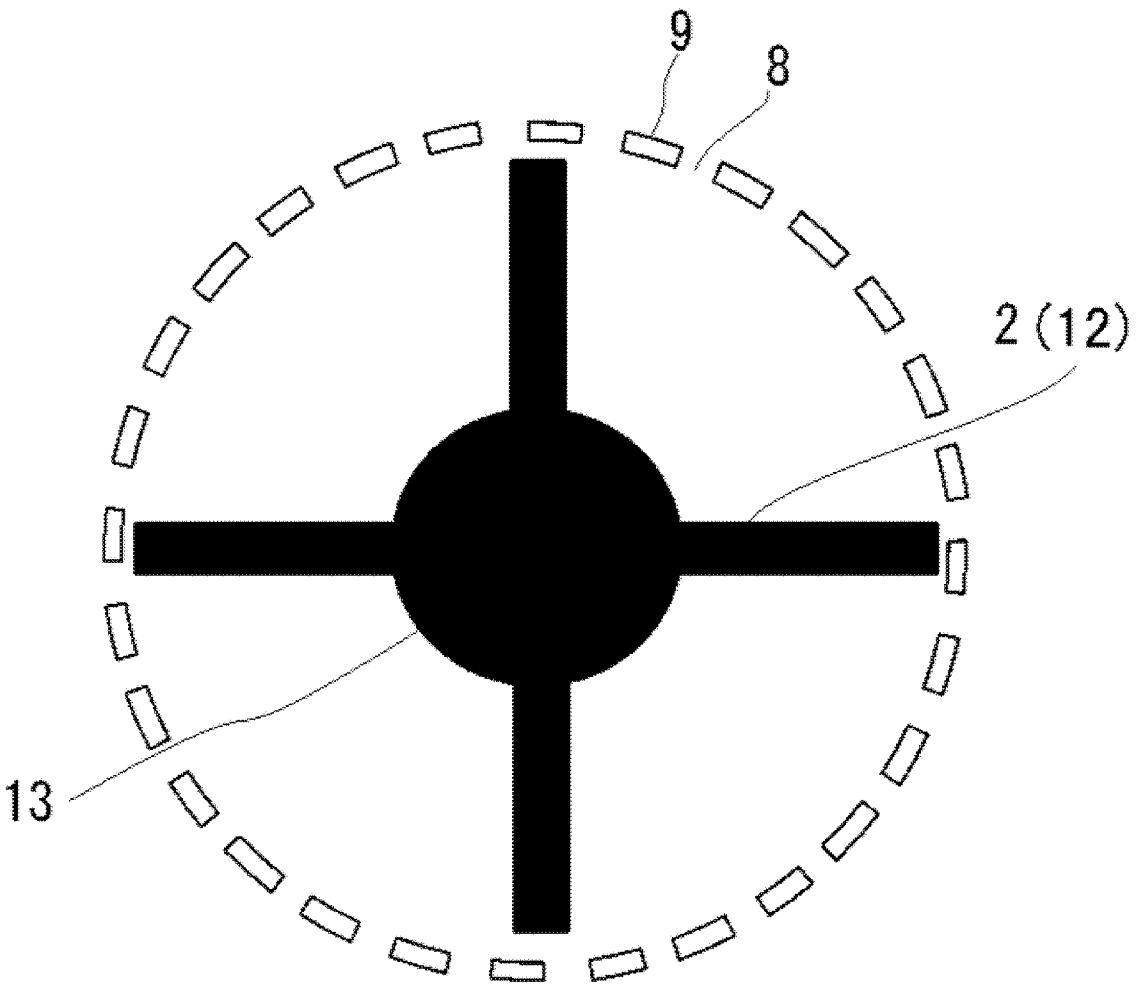
Figure 6:
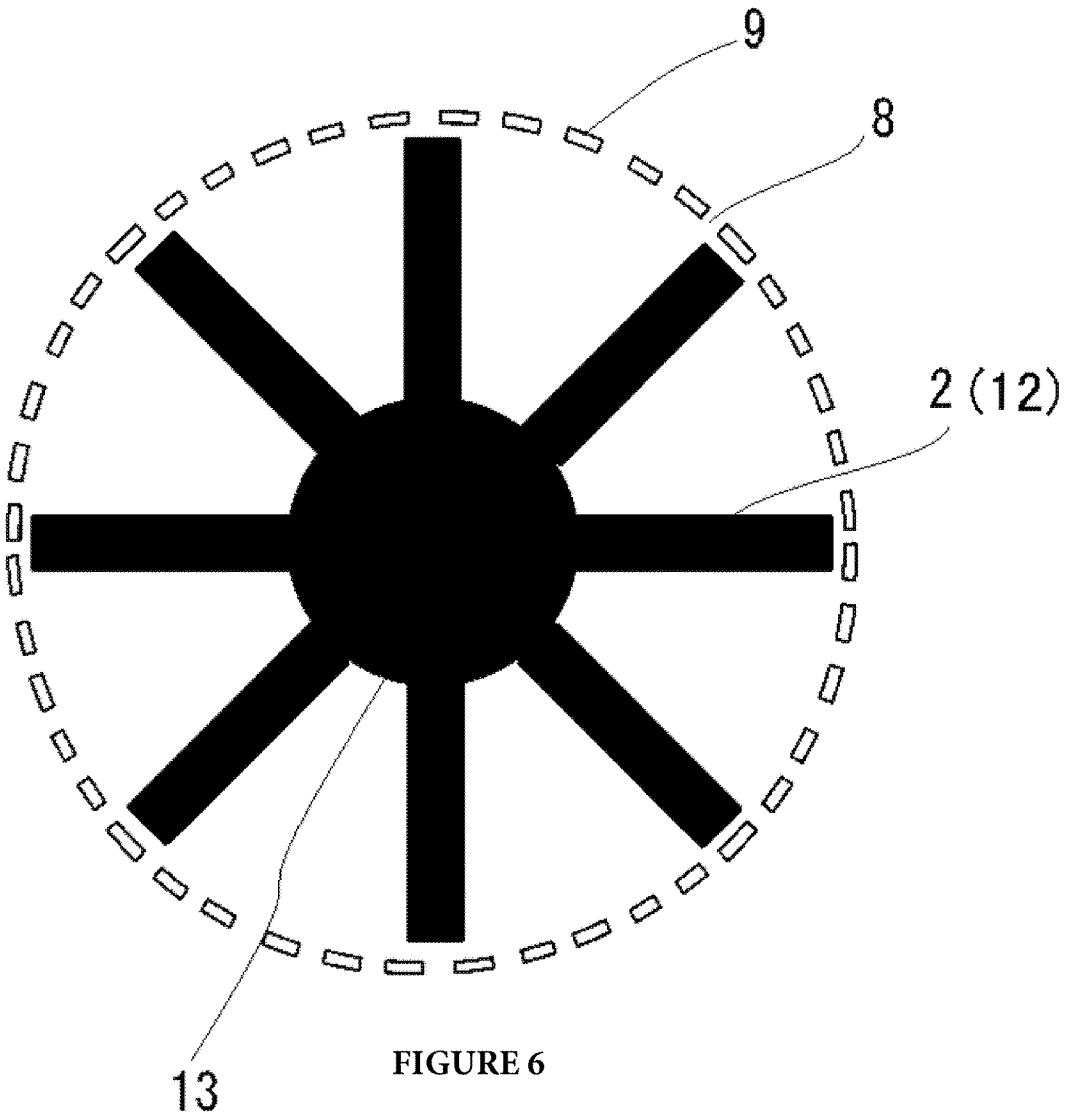

The blades 12 of the rotor 2 that are extended radially and linearly from the center of the rotor 2 with a constant width in the traverse sectional view (the cross section perpendicular to the axial direction of the rotation axis 13), as shown in FIG. 5 and FIG. 6; however, they may become gradually wider in their sizes or may be warped as they are extending toward the outside.

Furthermore, in the axial direction of the rotation axis 13, the blades 12 that are extended linearly along the plane which includes the rotation axis 13 are shown; however, they may be extended warpingly like a spiral shape and so forth in the vertical direction. Naturally, the shape of each constructing member may be variously modified, provided that the fluid to be processed can be sheared between the blades 12 and the screen 9 by rotation of the rotor 2, and at the same time, the kinetic energy can be given to the fluid to be processed so as to generate the jet flow as mentioned above.

The clearance between the screen 9 and the blades 12 may be arbitrarily changed so far as the shear force and the jet flow as mentioned above can be generated; however, usually the clearance is preferably in the range of about 0.2 to 2.0 mm. In addition, this clearance may be set so as to be adjustable by making at least any one of the stirring chamber 7 and the rotor 2 movable in the axial direction.

The sizes of the screen 9, the slits 8, and the rotor 2, as well as the relationships among them need to satisfy the following conditions.

In the case that only the rotor 2 is rotated at a high speed while not rotating the screen 9, when the maximum outer diameter of the rotor 2 is shown by D (m), the rotation number of the rotor 2 is shown by N (revolutions/sec), the number of the blades 12 is shown by X, and the number of the slits 8 is shown by Y, the circumferential velocity V (m/sec) of rotation of the rotor 2 is shown by the equation (1), and the frequency Z (kHz) of the intermittent jet flow is shown by the equation (2).

$$V=D\times\pi\times N \tag{1}$$

$$Z=N\times X\times Y\div 1000 \tag{2}$$

Here, the maximum outer diameter D (m) of the rotor 2 shall be the maximum outer diameter of the region in which the blades 12 and the slits 8 match with each other (matching region). In more detail, in the direction of the rotation axis of the rotor 2, the blades 12 and the slits 8 have at least the matching region in which each shares at the same position; and the maximum outer diameter of the rotor 2 in this matching region is taken as the maximum outer diameter D (m).

Further, in the stirrer of the present invention, the circumferential velocity V obtained in the equation (1) and the equation (2) is set so as to be larger than 23 m/sec and smaller than 37 m/sec, and the frequency Z is set so as to be more than 35.

As shown in Examples described later, inventors of the present invention found that in the stage when the frequency Z became 40 or more after the frequency Z went over 35, the particle diameter of the intended particles obtained by emulsification and dispersion could be made smaller drastically, and that the variance indicator C. V. value of the particle diameter became smaller drastically. Although the reason for this is not necessarily clear yet, this phenomenon cannot be explained merely by increase of the rotation number; and therefore, inventors of the present invention consider that the jet flow discharged from the slits 8 is not always constant whereby this relates to the intermittent discharge. In more detail, it is thought that as a result of generation of the intermittent jet flow, increase/decrease of the pressure is generated in the fluid whereby influencing the pulverization of the particles, so that in the stage when the frequency Z becomes 40 or more after the frequency Z goes over 35, the action of increase/decrease of the pressure and the action of the shear force to the fluid to be processed between the blades 12 and the inner circumferential surface of the screen 9 can work much more effectively to the particles.

In addition, it was also found that when the frequency Z became more than 40, both the particle diameter and the variance of the particle diameter did not change so significantly. Accordingly, in order to carry out the fluid processing stably in terms of the particle diameter and the variance of the particle diameter, it is preferable to carry out the processing such as emulsification and dispersion by the stirrer under the condition of the frequency Z being 40 or more. Alternatively, if drastic changes in both the particle diameter and the variance of the particle diameter are desired, it can be said that preferably the processing be carried out under the condition of the frequency Z being in the range of 35 to 40. Furthermore, it was demonstrated that the upper limit of the frequency Z was less than 92 from the experiment results under the conditions that the rotation number N of the rotor 2 was 383.33 revolutions/sec, the number of the blades 12 was 6, and the number of the slits 8 was 40.

The numerical conditions of the screen 9, the slits 8, and the rotor 2, with which not only the conditions shown above can be covered but also one can assume suitable mass production based on the present technology, are as following.

Maximum inner diameter of the screen 9: 30 to 500 mm (however, the maximum inner diameter in the matching region)

Number of the slits 8: 30 to 800 slits

Maximum outer diameter of the rotor 2: 30 to 500 mm

Rotation number of the rotor 2: 15 to 390 revolutions/sec

As a matter of course, these numerical conditions show merely one example; and thus, in accordance with the progress of the technology in rotation control and the like down the road, the present invention does not exclude the conditions other than the above-mentioned conditions.

Figure 8:
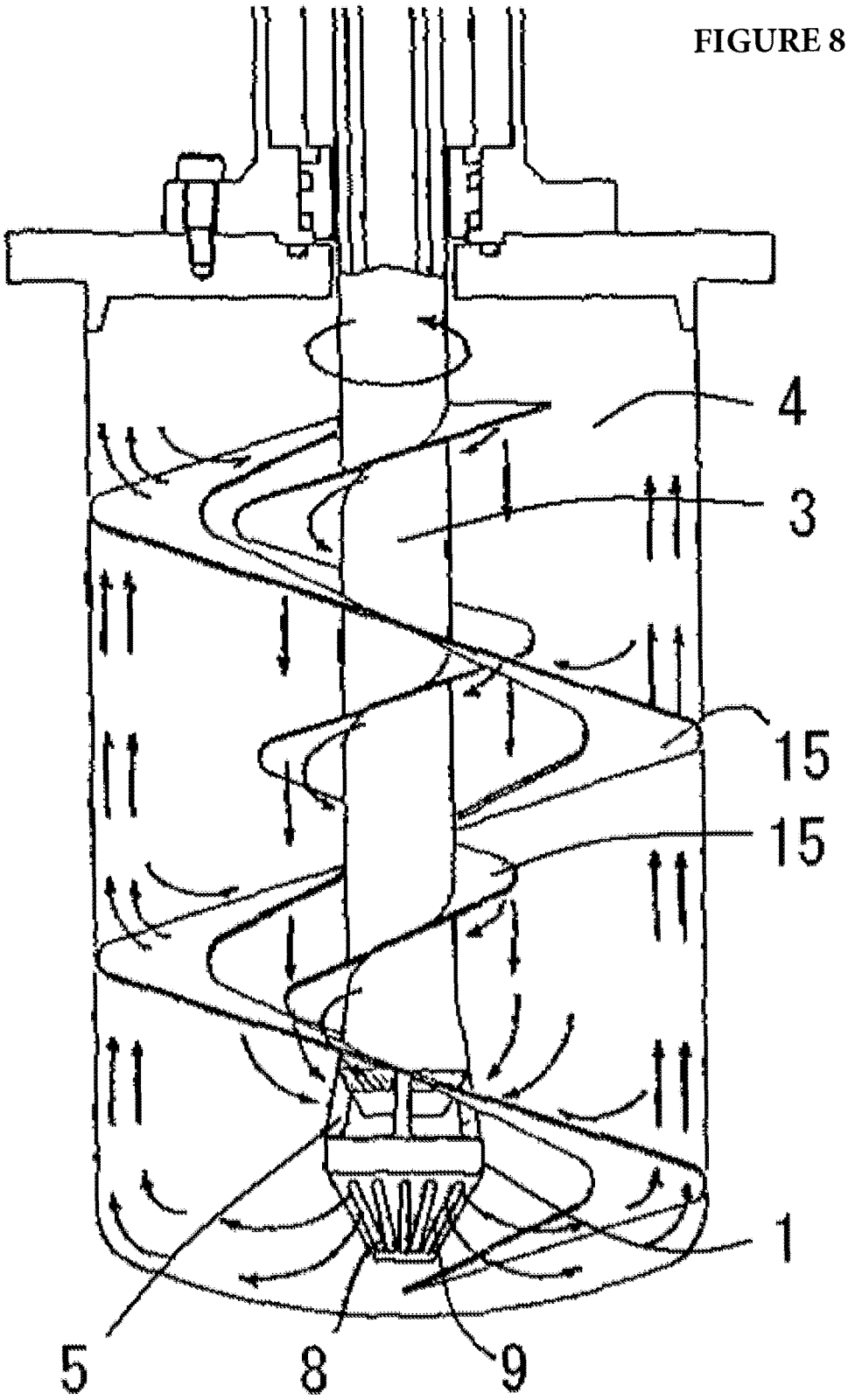

Next, in order to make the entirety of the fluid to be processed in the accommodating vessel 4 uniform by stirring, a separate stirring equipment may also be installed in the accommodating vessel 4. Alternatively, as shown in FIG. 8, the stirring blade 15 to stir the entirety inside the accommodating vessel 4 may be installed such that it may rotate integrally with the stirring chamber 7. In this case, both the stirring blade 15 and the stirring chamber 7 including the screen 9 are rotated together. During this time, the directions of the rotations of the stirring blade 15 and of the stirring chamber 7 may be either as same as the direction of the rotation of the rotor 2 or opposite to it. That is, because rotation of the stirring chamber 7 including the screen 9 becomes slower relative to rotation of the rotor 2 (specifically the circumferential velocity of rotation of the screen is in the range of about 0.02 to 0.5 m/sec), this does not significantly influence the shear force and the jet flow; and thus, both the circumferential velocity V (m/sec) and the frequency Z (kHz) of the intermittent jet flow may be set similarly to the afore-mentioned.

Figure 9:
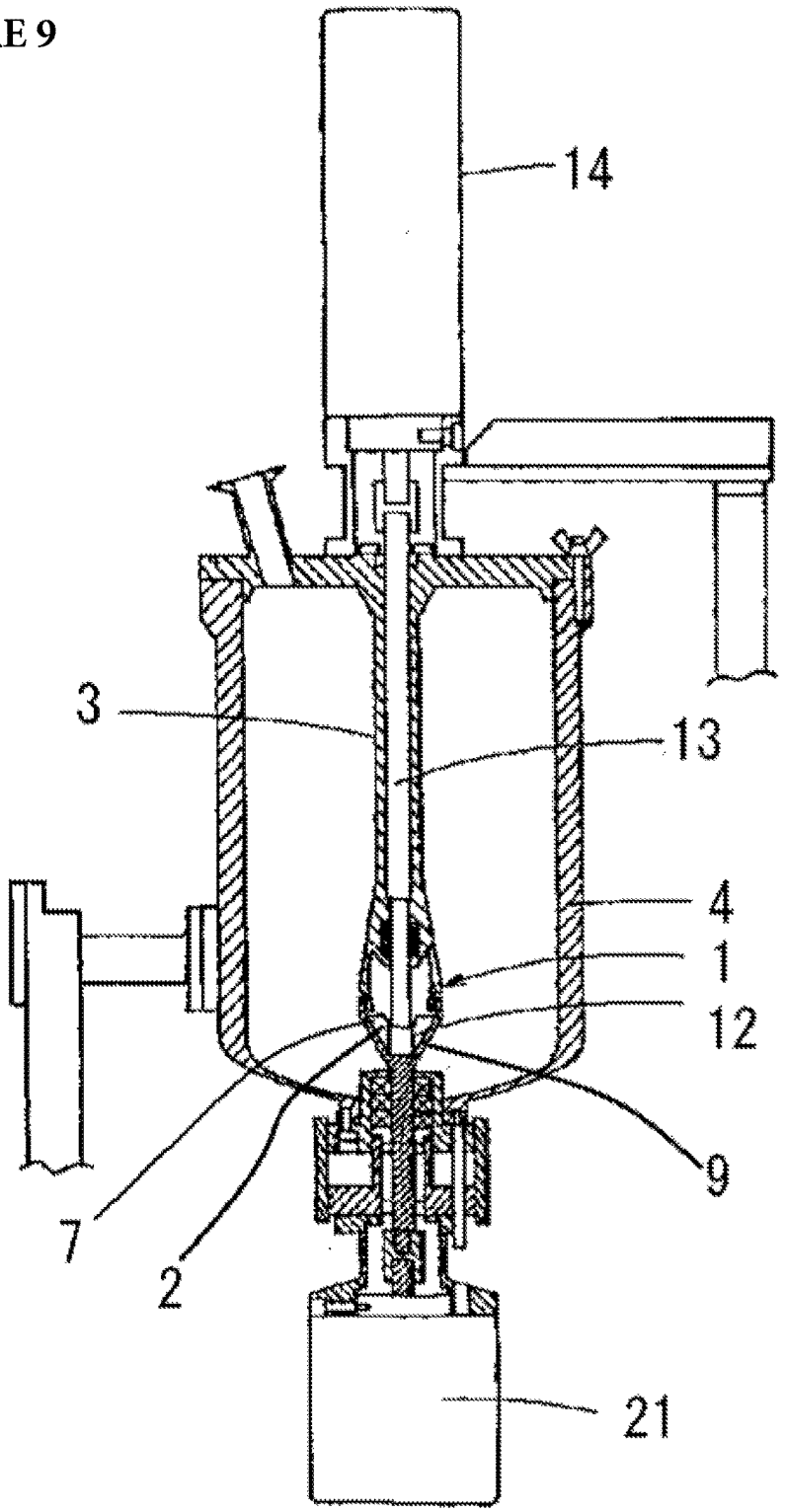

Next, the second embodiment will be explained by referring to FIG. 9, wherein the explanation will be centered in the points that are different from those in the previous embodiment; and thus, explanation of the same points will be omitted.

In the previous embodiment, the stirring chamber 7 including the screen 9 is not rotated (this includes the rotation at a slow rotation speed); however, in this embodiment, the screen 9 is rotated at a high rotation speed. Specifically, the stirring chamber 7 is made rotatable relative to the supporting tube 3; and thus, the rotation axis of the second motor 21 is connected to the front end of the stirring chamber 7 in such a way that the high speed rotation may be possible. The direction of rotation of the screen 9 is made opposite to the rotation direction of the rotor 2 arranged in the stirring chamber 7. By so doing, not only the relative rotation speed of the screen 9 to the rotor 2 increases, but also the frequency of the intermittent jet flow increases; but the kinetic energy given to the fluid to be processed by the blades 12 of the rotor 2 is the same as that of the previous embodiment. Therefore, conditions are different between the case of rotating only the rotor 2 and the case of rotating the screen 9 as well; and thus, the circumferential velocity V and the frequency Z are set as followings.

That is, when the maximum outer diameter of the rotor 2 in the matching region is shown by D (m), the rotation number of the rotor 2 is shown by N1, and the rotation number of the screen 9 is shown by N2, if the relative rotation number of the rotor 2 and the screen 9 is shown by N (revolutions/sec), the number of the blades 12 is shown by X, and the number of the slits 8 is shown by Y, then the circumferential velocity V (m/sec) of the relative rotation of the rotor 2 to the screen 9 is shown by the equation (1) and the frequency Z (kHz) of the intermittent jet flow is shown by the equation (2).

$$V=D\times\pi\times N(\text{however},N=N1+N2) \quad (1)$$

$$Z=N\times X\times Y\div 1000 \quad (2)$$

Then, in the stirrer of the present invention, the circumferential velocity V obtained from the equation (1) and the equation (2) is set so as to be larger than 48 m/sec and smaller than 85 m/sec, and the frequency Z is set so as to be more than 65.

In this embodiment, as shown in Examples described later, it was found that in the stage when the frequency Z became 68 or more after the frequency Z went over 65, the particle diameter of the intended particles obtained by emulsification and dispersion could be made smaller drastically, and that the variance indicator C. V. value of the particle diameter became smaller drastically.

In addition, it was also found that when the frequency Z became more than 68, both the particle diameter and the variance of the particle diameter did not change so significantly. Accordingly, in order to carry out the fluid processing stably in terms of the particle diameter and the variance of the particle diameter, it is preferable to carry out the fluid processing treatment such as emulsification and dispersion by the stirrer under the condition of the frequency Z being 68 or more. Alternatively, if drastic changes in both the particle diameter and the variance of the particle diameter are desired, it can be said that preferably the processing treatment be carried out with the frequency Z in the range of 65 to 68. Furthermore, it was demonstrated that the upper limit of the frequency Z was less than 184 from the experiment results under the conditions that the rotation number N1 of the rotor 2 was 383.33 revolutions/sec, the rotation number N2 of the screen was 383.33 revolutions/sec, the number of the blades 12 was 6, and the number of the slits 8 was 40.

The numerical conditions of the screen 9, the slits 8, and the rotor 2, with which not only the conditions shown above can be covered but also one can assume suitable mass production based on the present technology without problems, are as following.

Maximum inner diameter of the screen 9: 30 to 150 mm (however, the maximum inner diameter in the matching region)

Rotation number of the screen 9: 15 to 390 revolutions/sec

Number of the slits 8: 30 to 150

Maximum outer diameter of the rotor 2: 30 to 150 mm

Rotation number of the rotor 2: 15 to 390 revolutions/sec

As a matter of course, these numerical conditions show merely only one example; and thus, in accordance with the progress of the technology in rotation control and the like down the road, the present invention does not exclude the conditions other than the above-mentioned conditions.

EXAMPLES

Hereunder, the present invention will be explained further specifically by showing Examples. However, the present invention is not limited to the following Examples.

Measurement of the Particle Diameter Distribution:

Each of the particle diameter distribution in Examples is measured by MT-3300 (manufactured by Nikkiso Co., Ltd.).

Pure water was used as the solvent for measurement; and the refractive index of the particle was 1.81, and the refractive index of the solvent was 1.33. The results were obtained in terms of the volume distribution.

Figure 10:
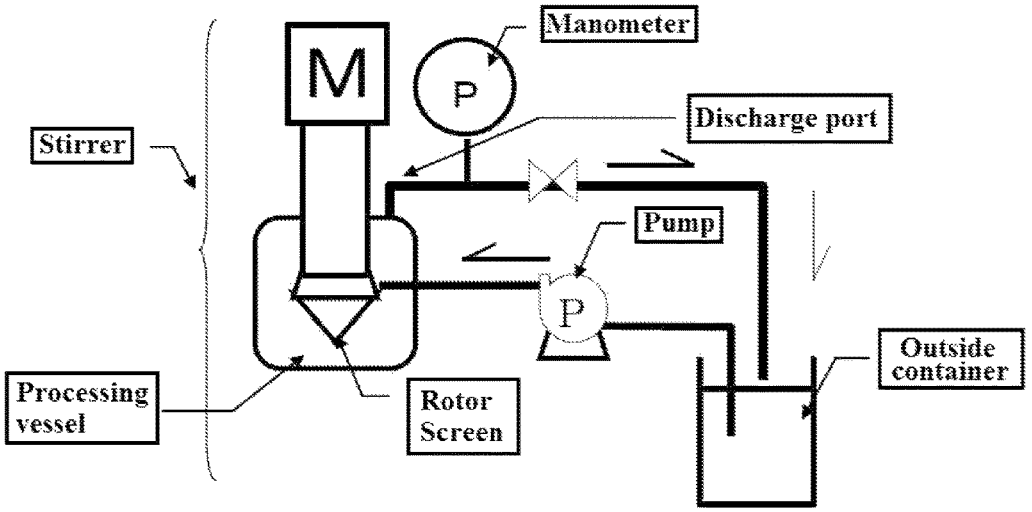
Figure 10:
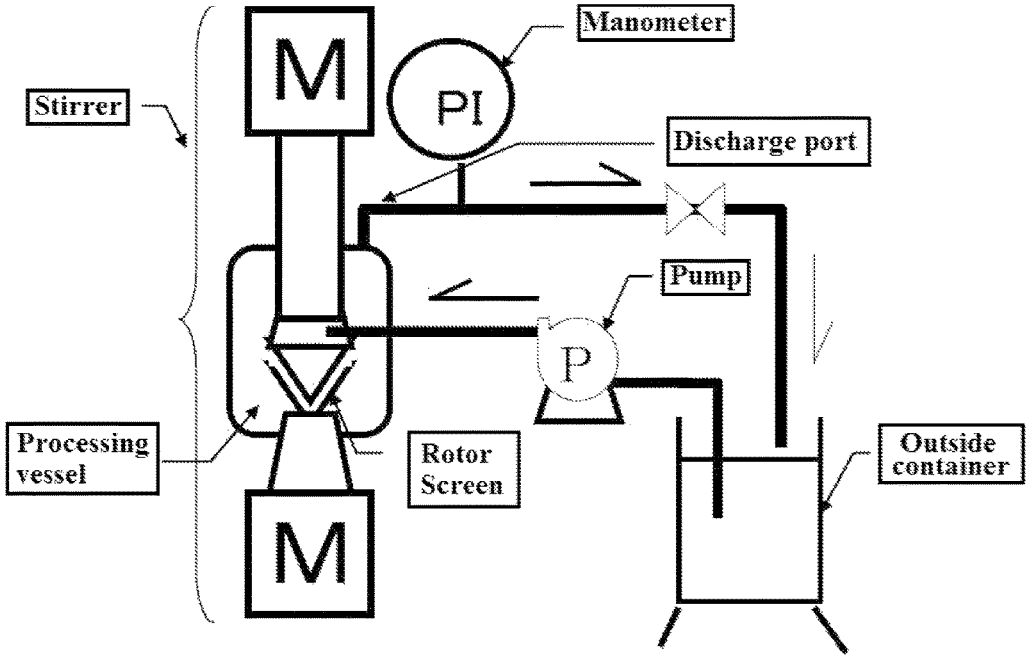
Figure 11:
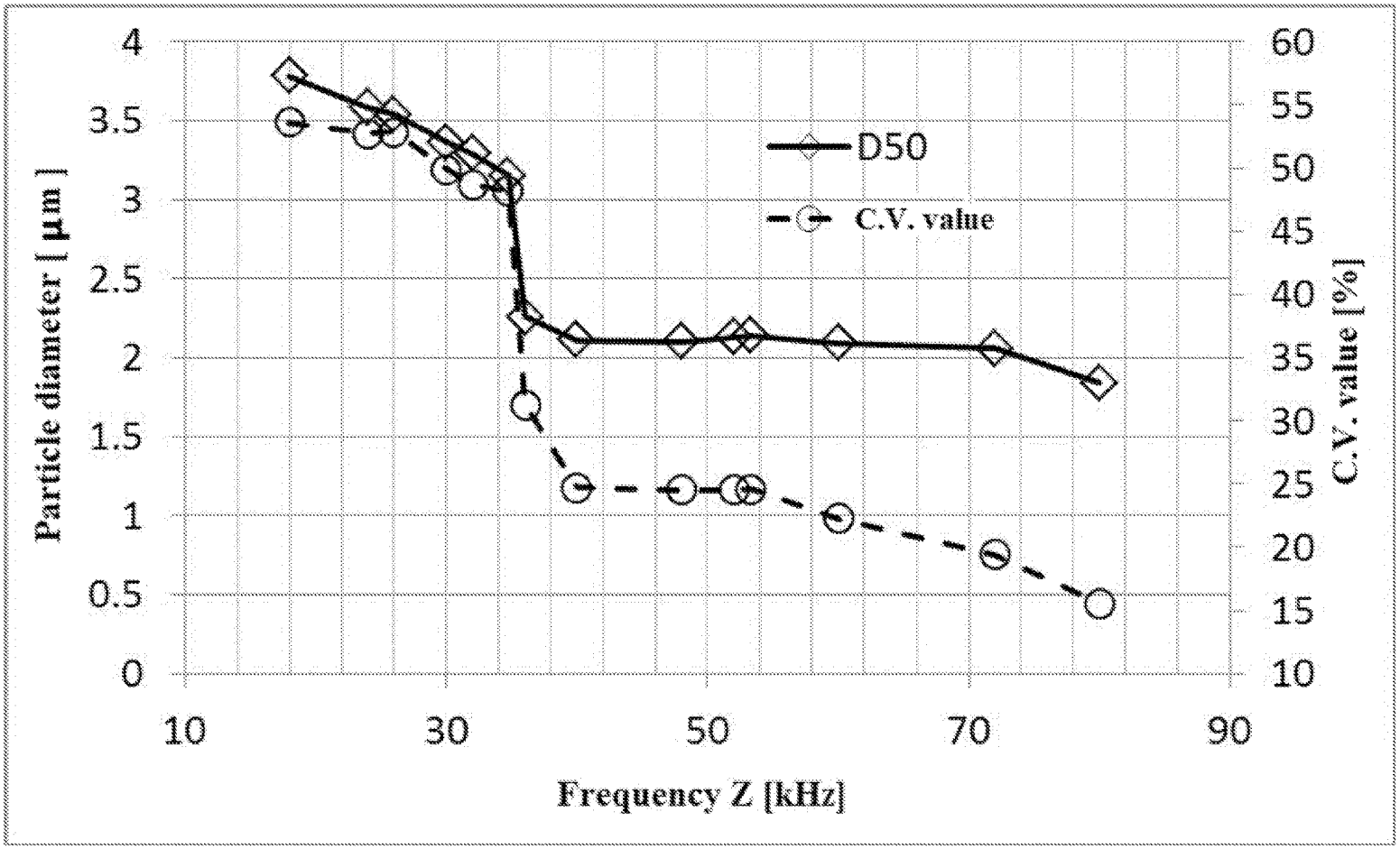

In Examples 1, by using the stirrer according to the first embodiment of the present invention (FIG. 1 and FIG. 2), the emulsification experiment of liquid paraffin and pure water was carried out in accordance with the flow diagram shown in FIG. 10(A). The formulation used in the emulsification experiment was a mixture of 29.4% by weight of liquid paraffin, 68.6% by weight of pure water, and as the emulsification agents, a mixture of 1.33% by weight of Tween 80 and 0.67% by weight of Span 80. By means of the pump shown in FIG. 10(A), the obtained formulate solution of the preliminary mixture in the outside container was introduced into the processing vessel 4 having the stirrer of the present invention therein, the processing vessel 4 was completely filled with the liquid, and the fluid to be processed was introduced into the processing vessel 4 by means of the pump, whereby discharging the fluid to be processed from the ejection port to carry out the emulsification treatment by rotating the rotor 2 of the stirrer of the present invention at the rotation speed of 333.33 revolutions/sec while circulating the fluid at the rate of 2500 g/minute. By changing the number of the blades 12 and the number of the slits 8, the particle diameter distribution results of the emulsified particles obtained after 30 minutes of the treatment are shown in terms of D50 and the C. V. value in Table 1. In FIG. 11, the graph comprising the frequency Z in the horizontal axis and the particle diameter (D50) and the C. V. value in the vertical axis is shown.

As shown in Table 1 and FIG. 11, it can be seen that when the circumferential velocity of rotation of the rotor 2 was 31.4 m/sec, if the frequency Z became larger than 35, then D50 and the C. V. value became significantly small. From this result, it was found that the emulsified particles having fine particle diameter and narrow particle diameter distribution, which had been impossible to be formed in the past, could be obtained by making Z larger than 35.

Figure 12:
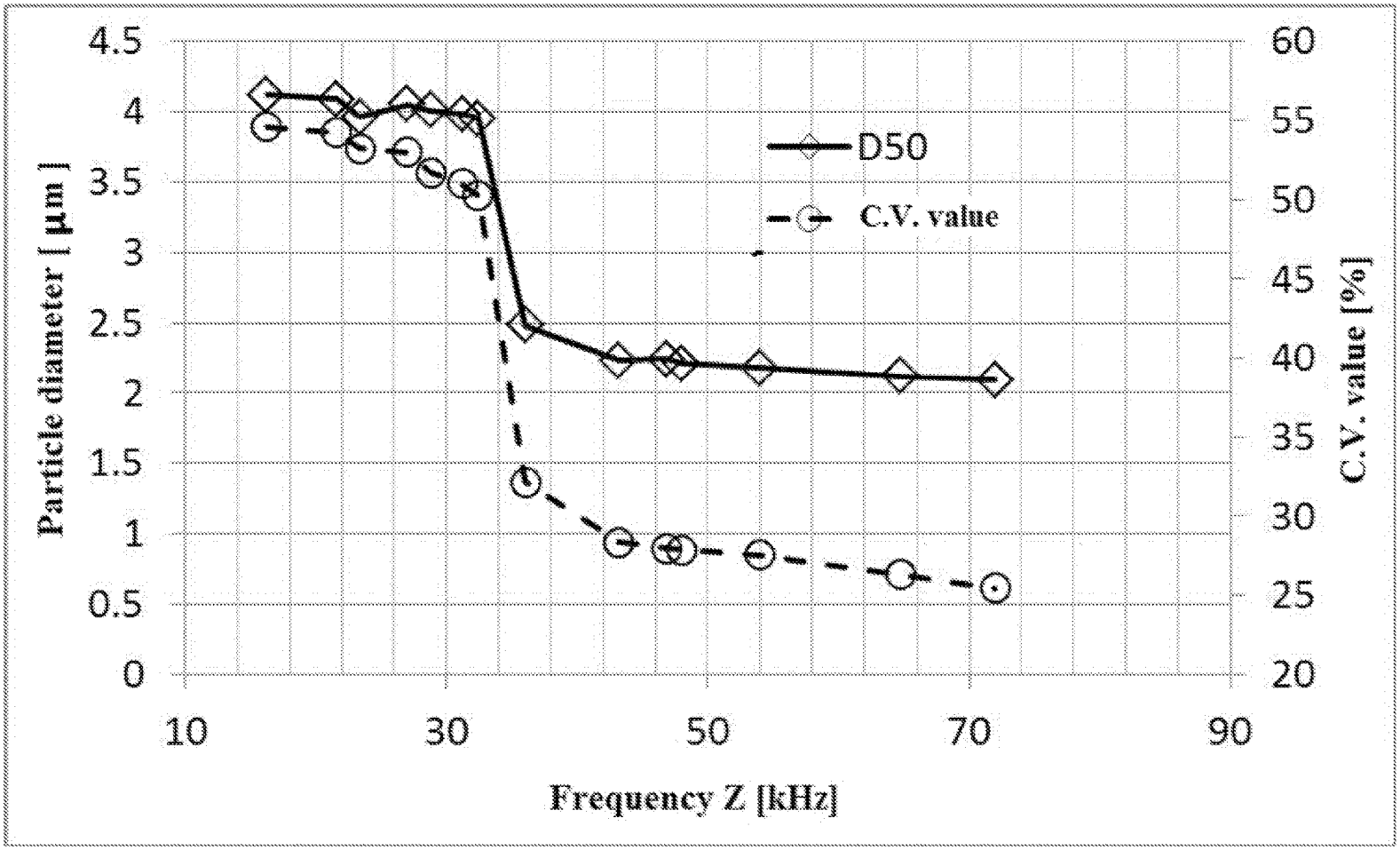

As Example 2, the procedure of Example 1 was repeated, except that the rotation number of the rotor 2 was set at 300 revolutions/sec and the circumferential velocity V of rotation of the rotor 2 was set at 28.3 m/sec, to obtain the results as shown in Table 2 and FIG. 12.

Figure 13:
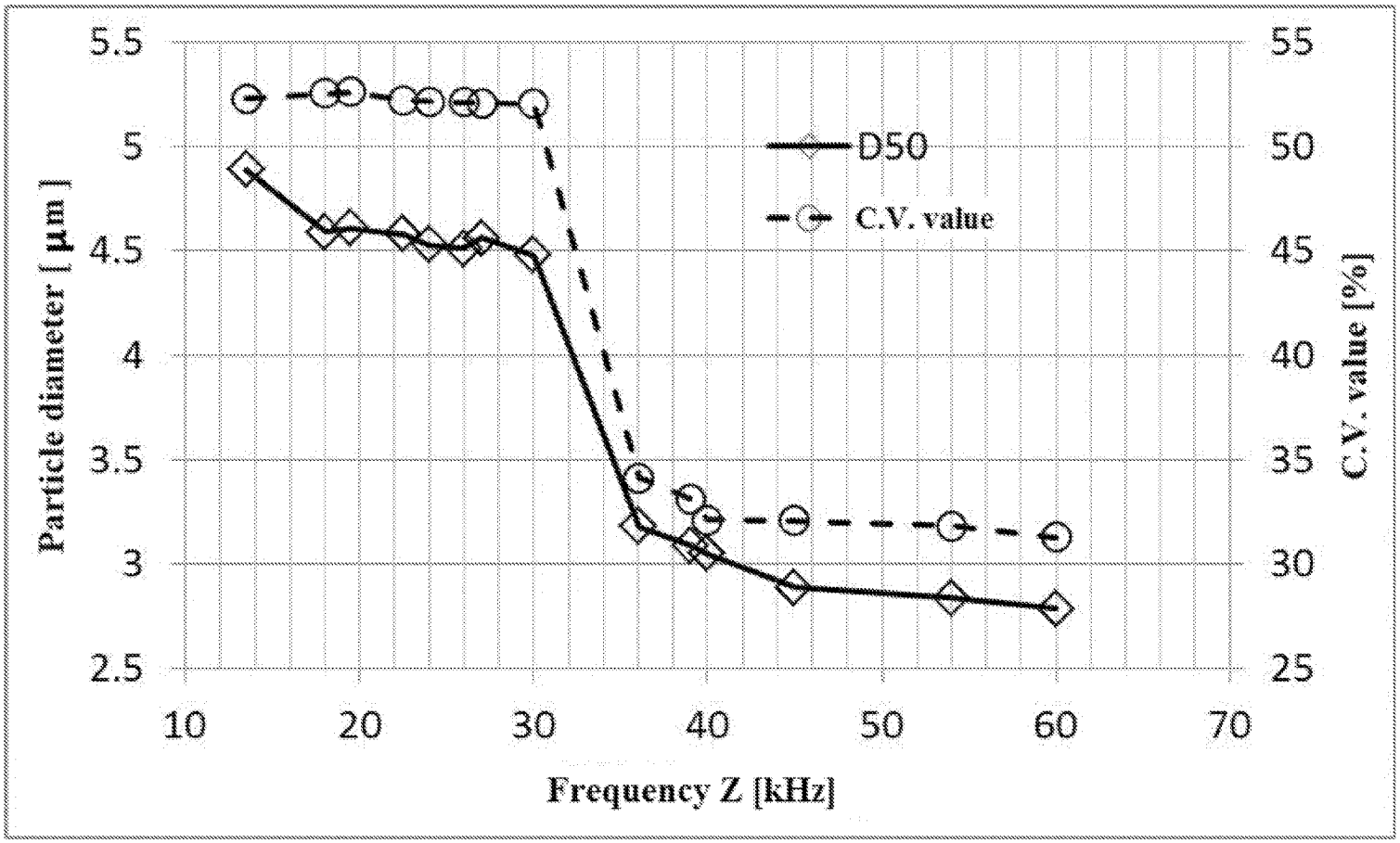

As Example 3, the procedure of Example 1 was repeated, except that the rotation number of the rotor 2 was set at 250 revolutions/sec and the circumferential velocity V of rotation of the rotor 2 was set at 23.6 m/sec, to obtain the results as shown in Table 3 and FIG. 13. In addition, when the procedure of Example 1 was repeated, except that the rotation number N of the rotor 2 was set at 383.33 revolutions/sec, the number X of the blades 12 was set at 6, and the number Y of the slits 8 was set at 40, similar results to Examples 1 to 3 were obtained. The frequency Z of this experiment was 91.9992.

Figure 14:
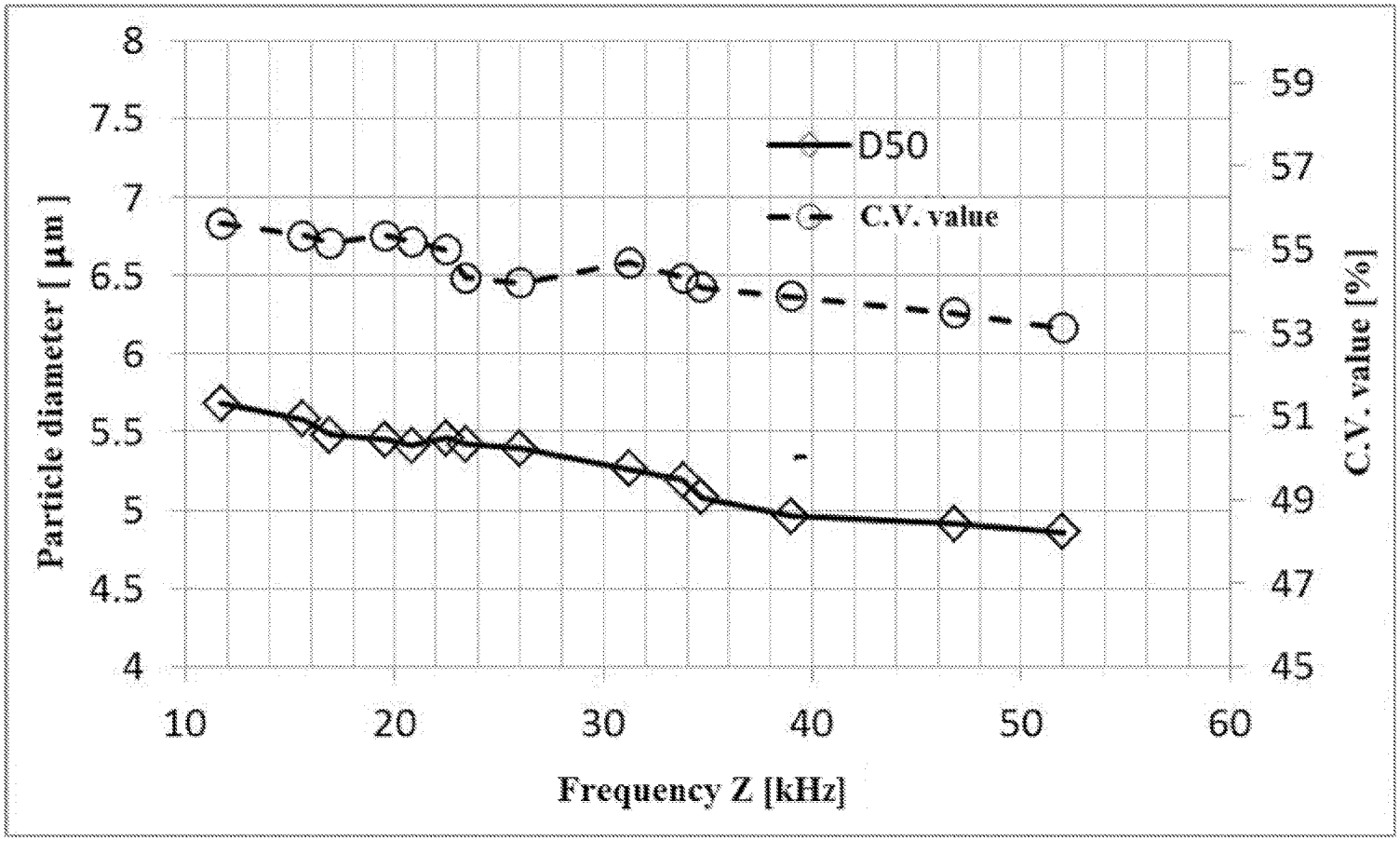

As Comparative Example 1, the procedure of Example 1 was repeated, except that the rotation number of the rotor 2 was set at 216.7 revolutions/sec and the circumferential velocity V of rotation of the rotor 2 was set at 20.4 m/sec, to obtain the results as shown in Table 4 and FIG. 14.

When the circumferential velocity was made 37 m/sec or higher, whatever the Z value was, unlikely to Examples 1 to 3, there was no decrease in the particle diameter, and in addition, a large C. V. value was resulted. It is assumed that by increasing the circumferential velocity too high, the cavitation took place significantly, whereby causing the hollowing phenomenon between the rotor 2 and the screen 9.

From the above results, when the circumferential velocity of rotation of the rotor 2 was higher than 23 m/sec, it was found that the particle diameter became clearly smaller, and that the C. V. value, the indicator of the variance of the particle diameter, became smaller as well, in the region where the frequency Z of the equation (2) was larger than 35 as compared with in the region thereof being 35 or less.

TABLE 1

Number of rotation N = 333.33 (revolutions/sec); Rotor diameter D = 0.030 (m); Circumferential velocity V = 31.4 (m/sec)

| Temperature inside the processing vessel: 20° C. | | Number of slits Y | | | | | |
|---|---|---|---|---|---|---|---|
| Pressure inside the processing vessel: 0.00 MPaG | | 18 | 24 | 26 | 30 | 36 | 40 |
| Number of blades X | 3 Frequency (kHz) | 18.0 | 24.0 | 26.0 | 30.0 | 36.0 | 40.0 |
| | Particle diameter after 30 minutes (μm)/C.V. value (%) | 3.78/53.6 | 3.58/52.7 | 3.50/52.8 | 3.36/49.85 | 2.26/31.24 | 2.11/24.68 |
| | 4 Frequency (kHz) | 24.0 | 32.0 | 34.7 | 40.0 | 48.0 | 53.3 |
| | Particle diameter after 30 minutes (μm)/C.V. value (%) | 3.53/52.6 | 3.29/48.65 | 3.15/48.12 | 2.11/24.68 | 2.10/24.50 | 2.14/24.60 |
| | 6 Frequency (kHz) | 36.0 | 48.0 | 52.0 | 60.0 | 72.0 | 80.0 |
| | Particle diameter after 30 minutes (μm)/C.V. value (%) | 2.24/31.19 | 2.12/24.48 | 2.13/24.55 | 2.09/22.30 | 2.06/19.41 | 1.84/15.6 |

TABLE 2

Number of rotation N = 300 (revolutions/sec); Rotor diameter D = 0.030 (m); Circumferential velocity V = 28.3 (m/sec)

| Temperature inside the processing vessel: 20° C. | | Number of slits Y | | | | | |
|---|---|---|---|---|---|---|---|
| Pressure inside the processing vessel: 0.00 MPaG | | 18 | 24 | 26 | 30 | 36 | 40 |
| Number of blades X | 3 Frequency (kHz) | 16.2 | 21.6 | 23.4 | 27.0 | 32.4 | 36.0 |
| | Particle diameter after 30 minutes (μm)/C.V. value (%) | 4.12/54.61 | 4.09/54.21 | 4.00/53.2 | 4.05/52.98 | 3.95/50.23 | 2.48/32.15 |

TABLE 2-continued

| Number of rotation N = 300 (revolutions/sec); Rotor diameter D = 0.030 (m); Circumferential velocity V = 28.3 (m/sec) | | | | | | | |
|---|---|---|---|---|---|---|---|
| Temperature inside the processing vessel: 20° C. | | Number of slits Y | | | | | |
| Pressure inside the processing vessel: 0.00 MPaG | | 18 | 24 | 26 | 30 | 36 | 40 |
| | 4 Frequency (kHz) | 21.6 | 28.8 | 31.2 | 36.0 | 43.2 | 48.0 |
| | Particle diameter after 30 minutes (μm)/C.V. value (%) | 4.06/54.16 | 4.01/51.68 | 3.98/50.23 | 2.48/32.15 | 2.23/28.36 | 2.21/27.54 |
| | 6 Frequency (kHz) | 32.4 | 43.2 | 46.8 | 54.0 | 64.8 | 72.0 |
| | Particle diameter after 30 minutes (μm)/C.V. value (%) | 3.95/50.23 | 2.23/28.36 | 2.21/27.54 | 2.18/27.54 | 2.21/26.32 | 2.09/25.45 |

TABLE 3

| Number of rotation N = 250 (revolutions/sec); Rotor diameter D = 0.030 (m); Circumferential velocity V = 23.6 (m/sec) | | | | | | | |
|---|---|---|---|---|---|---|---|
| Temperature inside the processing vessel: 20° C. | | Number of slits Y | | | | | |
| Pressure inside the processing vessel: 0.00 MPaG | | 18 | 24 | 26 | 30 | 36 | 40 |
| Number of blades X | 3 Frequency (kHz) | 13.5 | 18.0 | 19.5 | 22.5 | 27.0 | 30.0 |
| | Particle diameter after 30 minutes (μm)/C.V. value (%) | 4.89/52.31 | 4.60/52.5 | 4.61/52.6 | 4.58/52.23 | 4.56/52.09 | 4.48/52.03 |
| | 4 Frequency (kHz) | 18.0 | 24.0 | 26.0 | 30.0 | 36.0 | 40.0 |
| | Particle diameter after 30 minutes (μm)/C.V. value (%) | 4.58/52.1 | 4.53/52.15 | 4.51/52.12 | 4.48/52.03 | 3.18/34.15 | 3.05/32.12 |
| | 6 Frequency (kHz) | 27.0 | 36.0 | 39.0 | 45.0 | 54.0 | 60.0 |
| | Particle diameter after 30 minutes (μm)/C.V. value (%) | 4.56/52.09 | 3.16/34.09 | 3.09/33.12 | 2.89/32.10 | 2.84/31.85 | 2.79/31.28 |

TABLE 4

| Number of rotation N = 216.7 (revolutions/sec); Rotor diameter D = 0.030 (m); Circumferential velocity V = 20.4 (m/sec) | | | | | | | |
|---|---|---|---|---|---|---|---|
| Temperature inside the processing vessel: 20° C. | | Number of slits Y | | | | | |
| Pressure inside the processing vessel: 0.00 MPaG | | 18 | 24 | 26 | 30 | 36 | 40 |
| Number of blades X | 3 Frequency (kHz) | 11.7 | 15.6 | 16.9 | 19.5 | 23.4 | 26.0 |
| | Particle diameter after 30 minutes (μm)/C.V. value (%) | 5.68/55.61 | 5.60/55.3 | 5.48/55.14 | 5.45/55.32 | 5.42/54.32 | 5.39/54.19 |
| | 4 Frequency (kHz) | 15.6 | 20.8 | 22.5 | 26.0 | 31.2 | 34.7 |
| | Particle diameter after 30 minutes (μm)/C.V. value (%) | 5.58/54.9 | 5.41/55.18 | 5.46/54.98 | 5.39/54.19 | 5.26/54.68 | 5.08/54.08 |
| | 6 Frequency (kHz) | 23.4 | 31.2 | 33.8 | 39.0 | 46.8 | 52.0 |
| | Particle diameter after 30 minutes (μm)/C.V. value (%) | 5.40/54.18 | 5.18/53.28 | 5.19/54.32 | 4.96/53.87 | 4.91/53.48 | 4.86/53.12 |

Contrary to Examples 1 to 3 and Comparative Example 1, in Examples 4 to 6, not only the rotor 2 was rotated but also the screen 9 was rotated in the opposite direction to the rotor 2. That is, these show Examples according to the second embodiment of the present invention (see FIG. 9). In this case, the flow diagram shown in FIG. 10(*b*) was used. The formulation, the circulation flow amount, and the circulation way are the same as those of Examples 1 to 3.

Figure 15:
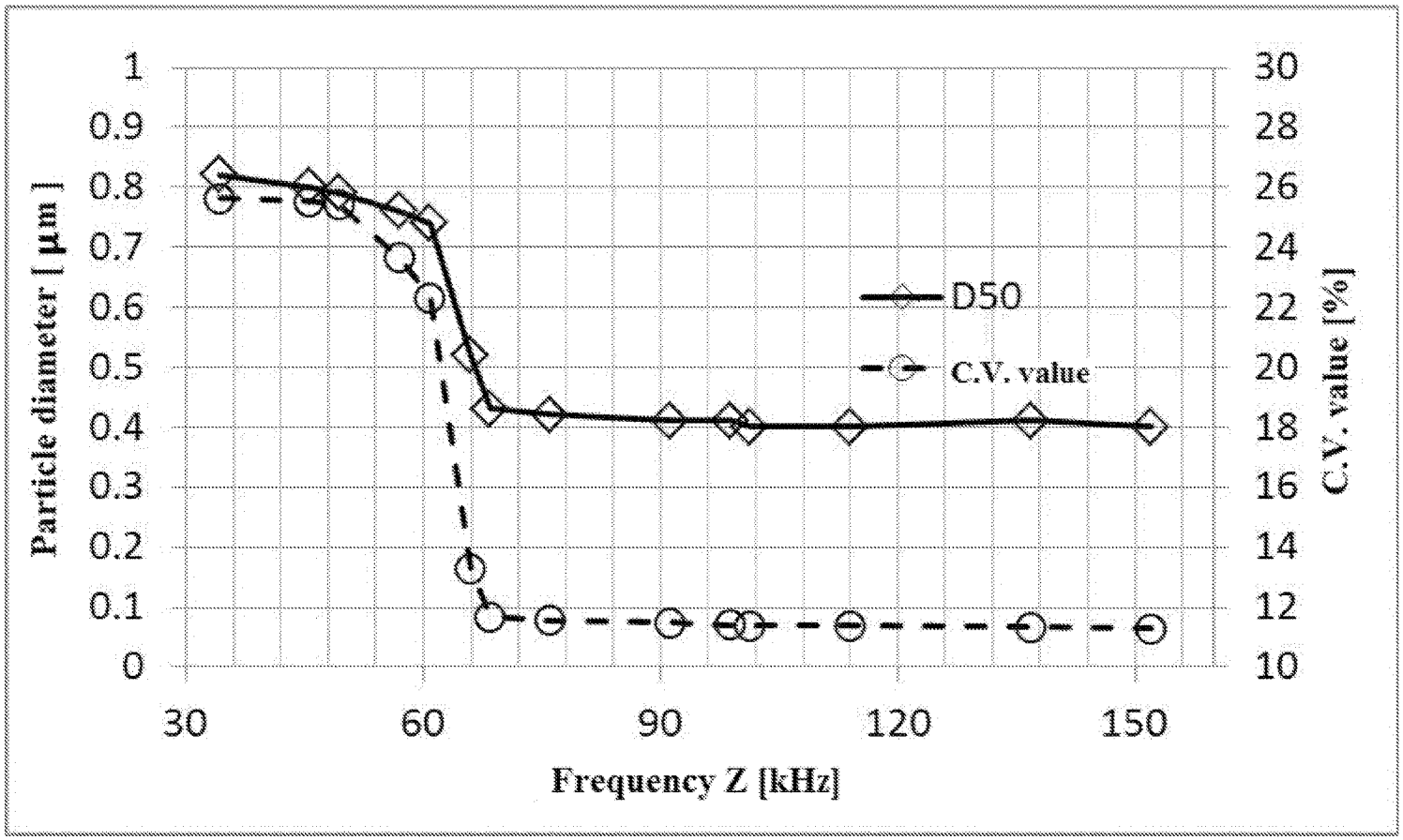

Example 4 was carried out by setting the relative rotation speed N of the rotor 2 and the screen 9 at 633 revolution/sec and the relative circumferential velocity V at 69.6 m/sec; and the results thereof are shown in Table 5 and FIG. 15.

Figure 16:
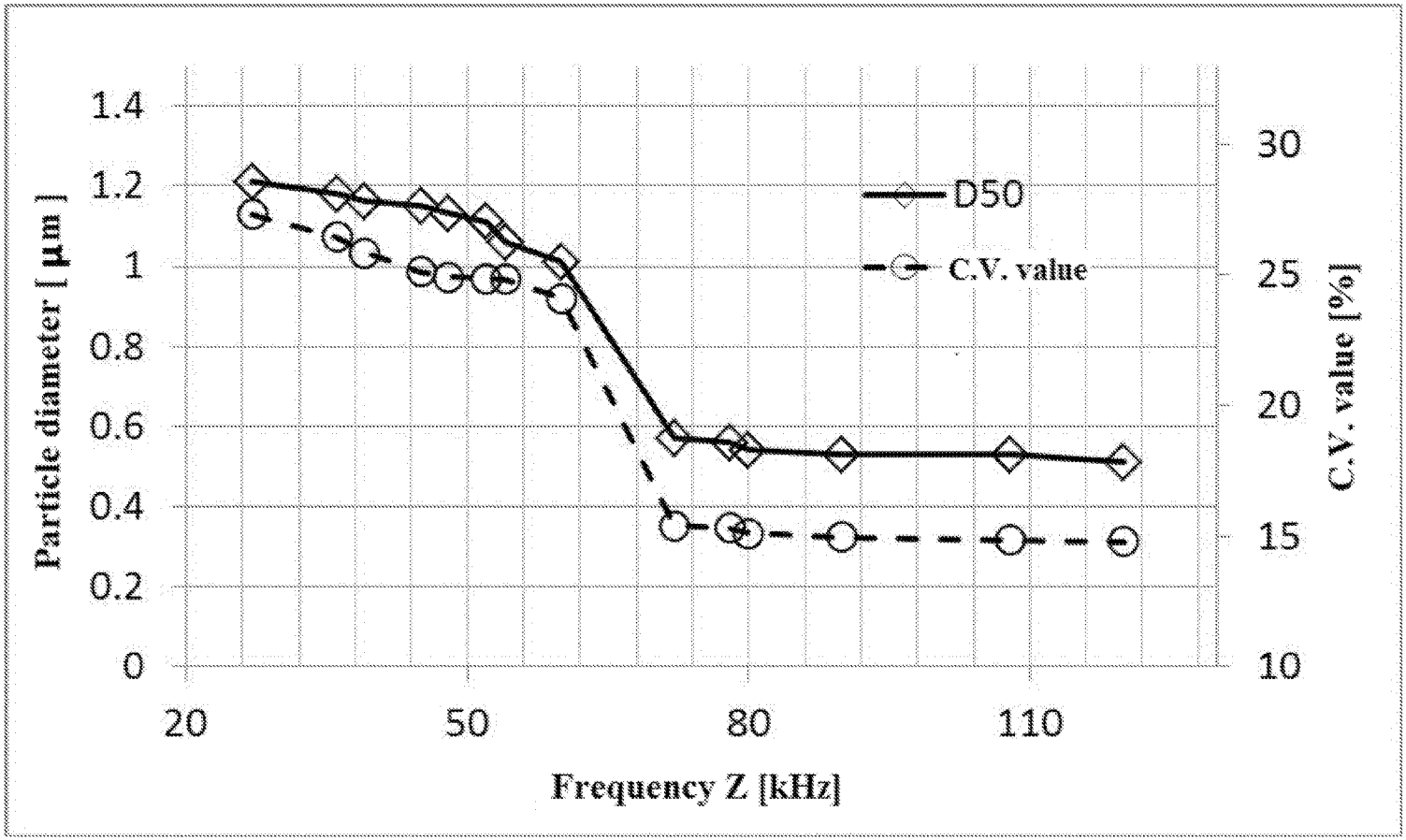

Example 5 was carried out by setting the relative rotation speed N of the rotor 2 and the screen 9 at 500 revolution/sec and the relative circumferential velocity V at 55.0 m/sec; and the results thereof are shown in Table 6 and FIG. 16.

Figure 17:
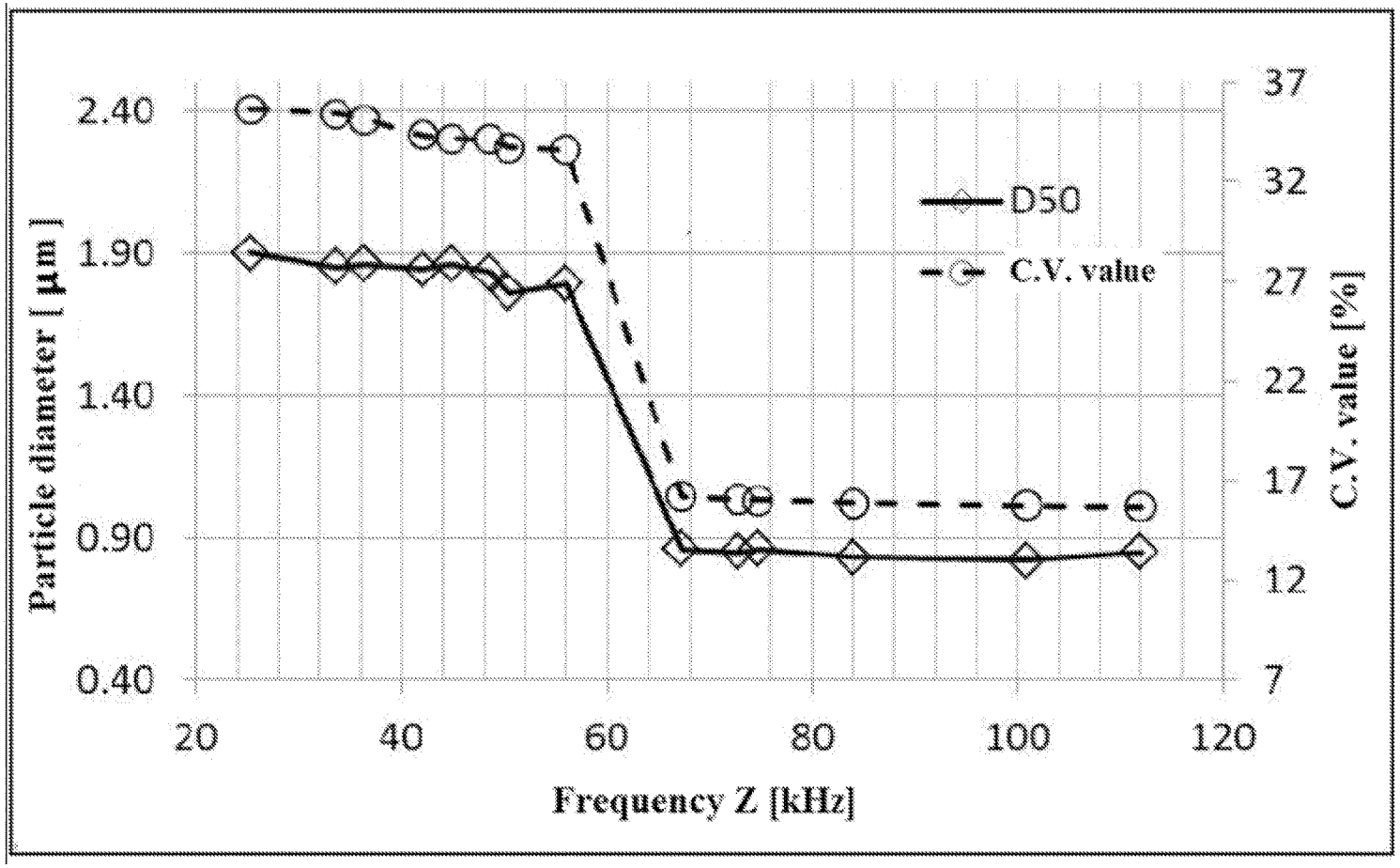

Example 6 was carried out by setting the relative rotation speed N of the rotor 2 and the screen 9 at 466.7 revolution/sec and the relative circumferential velocity V at 51.3 m/sec; and the results thereof are shown in Table 7 and FIG. 17.

In addition, when the procedure of Example 4 was repeated, except that the rotation number N1 of the rotor 2 was increased to 383.33 revolutions/sec, and the rotation number N2 of the screen 9 was increased to 383.33 revolutions/sec (relative rotation number of the rotor 2 to the screen 9 was increased to 766.66 revolutions/sec), while the number X of the blades 12 was 6, and the number Y of the slits 8 was 40, similar results to Examples 4 to 6 were obtained. The frequency Z of this experiment was 183.9984.

Meanwhile, when the procedure of Example 4 was repeated except that the relative rotation number N was set 437 revolutions/sec, similarly to Examples 4 to 6, it was found that the particle diameter became small, and that the C. V. value, the indicator of the variance of the particle diameter, became small, in the region where the frequency Z was larger than 65.

Figure 18:
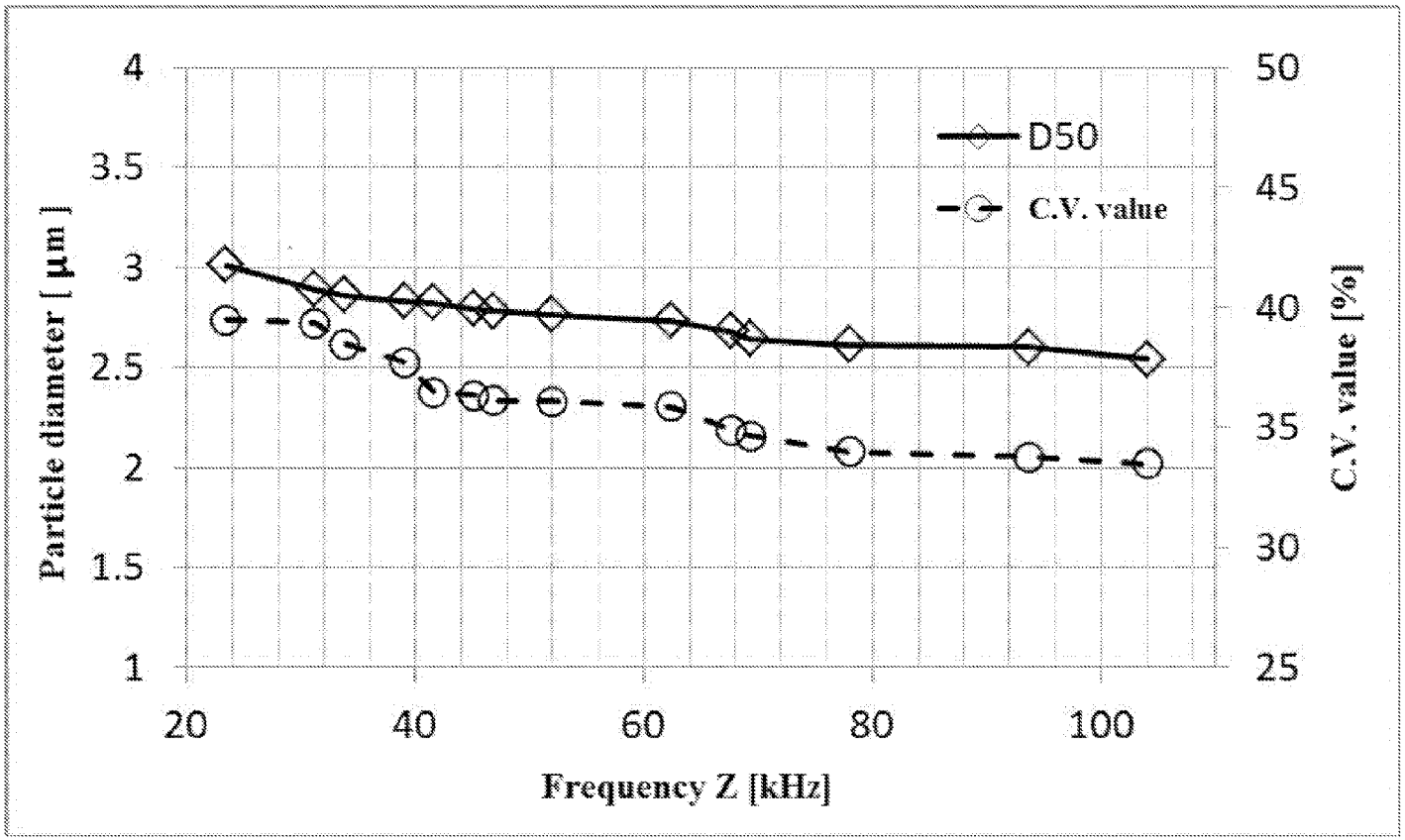

As Comparative Example 2, the relative rotation number N of the rotor and the screen was set at 433 rps, and the relative circumferential velocity V was set at 47.6 m/sec. The results of this experiment are shown in Table 8 and FIG. 18.

When the circumferential velocity was made to 85 m/sec or higher, whatever the Z value was, unlikely to Examples 4 to 6, there was no decrease in the particle diameter, and in addition, a large C. V. value was resulted. It is assumed that by increasing the circumferential velocity too high, the cavitation took place significantly, whereby causing the hollowing phenomenon between the rotor 2 and the screen 9.

From the above results, when the relative circumferential velocity of the rotor 2 and the screen 9 was higher than 48 m/sec, it was found that the particle diameter became clearly smaller, and that the C. V. value, the indicator of the variance of the particle diameter, became smaller as well, in the region where the frequency Z of the equation (2) was larger than 65 as compared with in the region thereof being 65 or less.

TABLE 5

Number of rotation N = 633 (revolutions/sec); Rotor diameter D = 0.035 (m); Circumferential velocity V = 69.6 (m/sec)

| Temperature inside the processing vessel: 40° C. | | | Number of slits Y | | | | | |
|---|---|---|---|---|---|---|---|---|
| Pressure inside the processing vessel: 0.00 MPaG | | | 18 | 24 | 26 | 30 | 36 | 40 |
| Number of blades X | 3 | Frequency (kHz) | 34.2 | 45.6 | 49.4 | 57.0 | 68.4 | 76.0 |
| | | Particle diameter after 30 minutes (μm)/C.V. value (%) | 0.82/25.64 | 0.8/25.5 | 0.79/25.41 | 0.76/23.64 | 0.43/11.68 | 0.43/11.68 |
| | 4 | Frequency (kHz) | 45.6 | 60.8 | 65.9 | 76.0 | 91.2 | 101.3 |
| | | Particle diameter after 30 minutes (μm)/C.V. value (%) | 0.82/25.3 | 0.74/22.32 | 0.52/13.28 | 0.42/11.48 | 0.41/11.49 | 0.40/11.39 |
| | 6 | Frequency (kHz) | 68.4 | 91.2 | 98.8 | 114.0 | 136.8 | 152.0 |
| | | Particle diameter after 30 minutes (μm)/C.V. value (%) | 0.43/11.68 | 0.41/11.42 | 0.41/11.42 | 0.40/11.38 | 0.41/11.35 | 0.40/11.28 |

TABLE 6

Number of rotation N = 500 (revolutions/sec); Rotor diameter D = 0.035 (m); Circumferential velocity V = 55.0 (m/sec)

| Temperature inside the processing vessel: 40° C. | | | Number of slits Y | | | | | |
|---|---|---|---|---|---|---|---|---|
| Pressure inside the processing vessel: 0.00 MPaG | | | 18 | 24 | 26 | 30 | 36 | 40 |
| Number of blades X | 3 | Frequency (kHz) | 27.0 | 36.0 | 39.0 | 45.0 | 54.0 | 60.0 |
| | | Particle diameter after 30 minutes (μm)/C.V. value (%) | 1.21/27.32 | 1.20/26.5 | 1.16/25.85 | 1.15/25.12 | 1.06/24.83 | 1.01/24.12 |
| | 4 | Frequency (kHz) | 36.0 | 48.0 | 52.0 | 60.0 | 72.0 | 80.0 |
| | | Particle diameter after 30 minutes (μm)/C.V. value (%) | 1.23/26.8 | 1.13/24.91 | 1.11/24.85 | 1.01/24.12 | 0.57/15.41 | 0.54/15.12 |
| | 6 | Frequency (kHz) | 54.0 | 72.0 | 78.0 | 90.0 | 108.0 | 120.0 |
| | | Particle diameter after 30 minutes (μm)/C.V. value (%) | 1.06/24.83 | 0.56/15.38 | 0.56/15.32 | 0.53/14.86 | 0.53/14.86 | 0.51/14.81 |

TABLE 7

Number of rotation N = 466.7 (revolutions/sec); Rotor diameter D = 0.035 (m); Circumferential velocity V = 51.3 (m/sec)

| Temperature inside the processing vessel: 40° C. | | | Number of slits Y | | | | | |
|---|---|---|---|---|---|---|---|---|
| Pressure inside the processing vessel: 0.00 MPaG | | | 18 | 24 | 26 | 30 | 36 | 40 |
| Number of blades X | 3 | Frequency (kHz) | 25.2 | 33.6 | 36.4 | 42.0 | 50.4 | 56.0 |
| | | Particle diameter after 30 minutes (μm)/C.V. value (%) | 1.90/35.64 | 1.85/35.4 | 1.86/35.12 | 1.84/34.32 | 1.76/33.68 | 1.79/33.58 |
| | 4 | Frequency (kHz) | 33.6 | 44.8 | 48.5 | 56.0 | 67.2 | 74.7 |
| | | Particle diameter after 30 minutes (μm)/C.V. value (%) | 1.84/35.1 | 1.86/34.12 | 1.83/34.08 | 1.79/33.58 | 0.86/16.2 | 0.86/16.02 |
| | 6 | Frequency (kHz) | 50.4 | 67.2 | 72.8 | 84.0 | 100.8 | 112.0 |
| | | Particle diameter after 30 minutes (μm)/C.V. value (%) | 1.76/33.58 | 0.86/16.20 | 0.85/16.06 | 0.83/15.87 | 0.82/15.76 | 0.85/15.68 |

TABLE 8

| Number of rotation N = 433 (revolutions/sec); Rotor diameter D = 0.035 (m); Circumferential velocity V = 47.6 (m/sec) | | | | | | | |
|---|---|---|---|---|---|---|---|
| Temperature inside the processing vessel: 40° C. | | Number of slits Y | | | | | |
| Pressure inside the processing vessel: 0.00 MPaG | | 18 | 24 | 26 | 30 | 36 | 40 |
| Number of blades X | 3 Frequency (kHz) | 23.4 | 31.2 | 33.8 | 39.0 | 46.8 | 52.0 |
| | Particle diameter after 30 minutes (μm)/C.V. value (%) | 3.01/39.45 | 2.9/39.3 | 2.86/38.45 | 2.83/37.69 | 2.78/36.12 | 2.76/36.12 |
| | 4 Frequency (kHz) | 31.2 | 41.6 | 45.1 | 52.0 | 62.4 | 69.3 |
| | Particle diameter after 30 minutes (μm)/C.V. value (%) | 2.9/39.3 | 2.82/36.45 | 2.79/36.32 | 2.76/36.08 | 2.73/35.86 | 2.64/34.63 |
| | 6 Frequency (kHz) | 46.8 | 62.4 | 67.6 | 78.0 | 93.6 | 104.0 |
| | Particle diameter after 30 minutes (μm)/C.V. value (%) | 2.74/35.98 | 2.71/35.68 | 2.68/34.89 | 2.61/33.98 | 2.60/33.76 | 2.54/33.46 |

Figure 19:
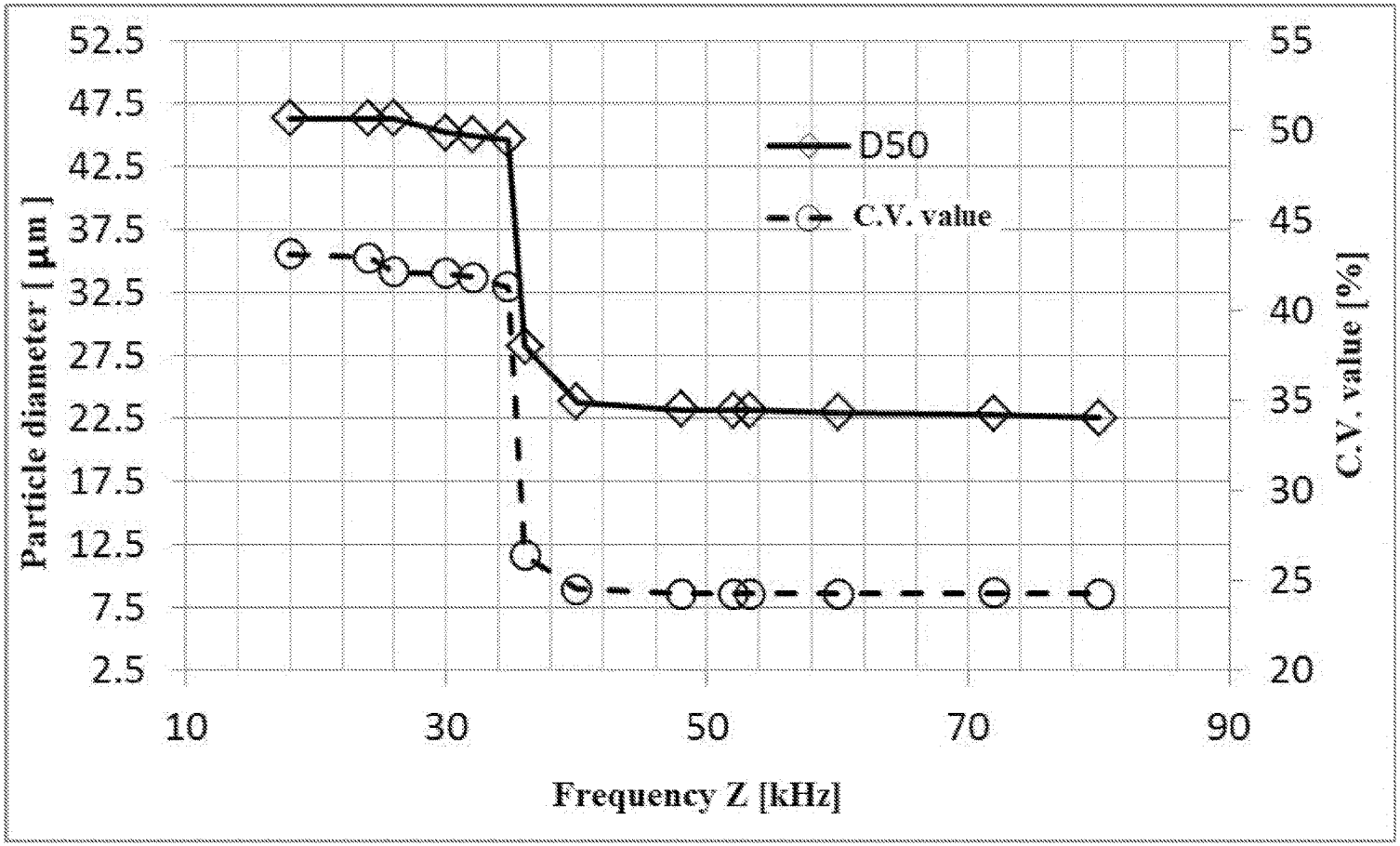

Dispersion Treatment of Pigments:

In Examples 7, by using the stirrer according to the first embodiment of the present invention (FIG. 1 and FIG. 2), the dispersion treatment of pigments was carried out in accordance with the flow diagram shown in FIG. 10(A). The formulation of substance to be processed was a mixture of 5% by weight of red pigment (C. I. Pigment Red 177) having the primary particle diameter of 20 to 30 nm, 5% by weight of BYK-2000 (manufactured by BYK Japan KK) as the dispersant, and 90% by weight of the mixed solution of propylene glycol monomethyl ether acetate (PGMEA) and propylene glycol monomethyl ether (PGME) (PGMEA/PGME=4/1 (volume ratio)). By means of the pump shown in FIG. 10(A), the obtained substance to be processed of the preliminary mixture in the outside container was introduced into the processing vessel 4 having the stirrer of the present invention therein, the processing vessel 4 was completely filled with the liquid, and the fluid to be processed was introduced into the processing vessel 4 by means of the pump, whereby discharging the fluid to be processed from the discharge port to carry out the dispersion treatment by rotating the rotor 2 of the stirrer of the present invention at the rotation speed of 333.33 revolutions/sec while circulating the fluid at the rate of 2300 g/minute. By changing the number X of the blades 12 and the number Y of the slits 8, the particle diameter distribution results of the fine particles obtained after 30 minutes of the treatment are shown in terms of D50 and the C. V. value in Table 9. In FIG. 19, the graph comprising the frequency Z in the horizontal axis and the particle diameter (D50) and the C. V. value in the vertical axis is shown. The same conditions as Example 1 were used with regard to the number of the blades 12 of the rotor 2, the number Y of the slits 8, and the frequency.

Measurement of the Particle Diameter Distribution:

Each of the particle diameter distribution in the following Example is measured by UPA-150UT (manufactured by Nikkiso Co., Ltd.). Pure water was used as the solvent for measurement; and the refractive index of the particle was 1.81, and the refractive index of the solvent was 1.33. The results were obtained in terms of the volume distribution.

From the above results, in the dispersion treatment of pigments, it was also found that the particle diameter became clearly smaller, and that the C. V. value, the indicator of the variance of the particle diameter, became smaller as well, in the region where the frequency Z of the equation (2) was larger than 35 as compared with in the region thereof being 35 or less. When the circumferential velocity was 37 m/sec or higher, whatever the Z value was, unlikely to Examples 1 to 3, there was no decrease in the particle diameter, and in addition, a large C. V. value was resulted. It is assumed that by increasing the circumferential velocity too high, the cavitation took place significantly, whereby causing the hollowing phenomenon between the rotor 2 and the screen 9.

TABLE 9

| Number of rotation N = 333.33 (revolutions/sec); Rotor diameter D = 0.030 (m); Circumferential velocity V = 31.4 (m/sec) | | | | | | | |
|---|---|---|---|---|---|---|---|
| Temperature inside the processing vessel: 20° C. | | Number of slits Y | | | | | |
| Pressure inside the processing vessel: 0.00 MPaG | | 18 | 24 | 26 | 30 | 36 | 40 |
| Number of blades X | 3 Frequency (kHz) | 18.0 | 24.0 | 26.0 | 30.0 | 36.0 | 40.0 |
| | Particle diameter after 30 minutes (μm)/C.V. value (%) | 46.3/43.2 | 46.3/43.0 | 46.3/42.2 | 45.2/42.1 | 28.3/26.5 | 23.8/24.6 |
| | 4 Frequency (kHz) | 24.0 | 32.0 | 34.7 | 40.0 | 48.0 | 53.3 |
| | Particle diameter after 30 minutes (μm)/C.V. value (%) | 46.1/44.1 | 45.0/41.9 | 44.7/41.3 | 23.8/24.6 | 23.2/24.3 | 23.1/24.3 |
| | 6 Frequency (kHz) | 36.0 | 48.0 | 52.0 | 60.0 | 72.0 | 80.0 |
| | Particle diameter after 30 minutes (μm)/C.V. value (%) | 28.2/26.4 | 23.2/24.3 | 23.2/24.3 | 23.0/24.3 | 22.8/24.3 | 22.6/24.3 |

REFERENCE NUMERALS

1. Processing member
2. Rotor
3. Supporting tube
4. Accommodating vessel
5. Sucking port
6. Sucking chamber
7. Stirring chamber
8. Slit
9. Screen
10. Comparting wall
11. Opening
12. Blade
13. Rotation axis
14. Motor
15. Stirring blade
21 Second motor

The invention claimed is:

1. A stirrer, comprising:

a housing including a sucking chamber and a stirring chamber, the sucking chamber and the stirring chamber being comparted by a comparting wall defining an introduction opening in a middle of the comparting wall;

a rotating rotor which includes a rotation axis extending through the sucking chamber and the stirring chamber via the introduction opening, and is equipped with plural blades; and a screen having plural slits which is arranged around the rotating rotor, each of the plural slits extending along substantially the entire length of the screen, wherein there is a matching region being an area of a direct overlap between the plural blades and the plural slits in a radial direction perpendicular to the rotation axis, wherein when a fluid to be processed is discharged as an intermittent jet flow through the plural slits from inside the screen to outside the screen by rotating the rotating rotor, a circumferential velocity V (m/sec) of rotation of the rotating rotor satisfies an equation (1) below:

$$V=D\times\pi\times N \quad (1),$$

where D (m) is maximum outer diameter of the rotating rotor in the matching region, N (revolutions/sec) is number of rotations of the rotating rotor over a unit of time, and a frequency Z (kHz) of the intermittent jet flow satisfies an equation (2) below:

$$Z=N\times X\times Y\div 1000 \quad (2),$$

where X is number of the plural blades, and Y is number of the plural slits, and wherein the circumferential velocity V is set so as to be larger than 23 m/sec and smaller than 37 m/sec, and the frequency Z is set so as to be more than 35 kHz.

2. The stirrer according to claim 1, wherein the frequency Z is set at less than 92 kHz.

3. The stirrer according to claim 1, wherein the screen does not rotate.

4. The stirrer according to claim 1, wherein diameters of the blades and of the screen become smaller as departing from an introduction port through which the fluid to be processed is introduced into the screen toward outside in the axial direction.

5. The stirrer according to claim 2, wherein the screen does not rotate.

6. The stirrer according to claim 2, wherein diameters of the blades and of the screen become smaller as departing from an introduction port through which the fluid to be processed is introduced into the screen toward outside in the axial direction.

7. The stirrer according to claim 3, wherein diameters of the blades and of the screen become smaller as departing from an introduction port through which the fluid to be processed is introduced into the screen toward outside in the axial direction.

8. The stirrer according to claim 1, wherein a clearance between the screen and the blades is 0.2-2 mm.

9. The stirrer according to claim 1, wherein a number of the plural blades is no less than 6, a number of the plural slits is 30-800, and a maximum outer diameter of the rotating rotor in the matching region is in a range from 30 mm to 500 mm.

10. A stirrer, comprising:

a housing including a sucking chamber and a stirring chamber, the sucking chamber and the stirring chamber being comparted by a comparting wall defining an introduction opening in a middle of the comparting wall;

a rotor which includes a rotation axis extending through the sucking chamber and the stirring chamber via the introduction opening, and is equipped with plural blades; and a screen having plural slits which is arranged around the rotating rotor, each of the plural slits extending along substantially the entire length of the screen, wherein there is a matching region being an area of a direct overlap between the plural blades and the plural slits in a radial direction perpendicular to the rotation axis, wherein when a fluid to be processed is ejected as an intermittent jet flow through the plural slits from inside the screen to outside the screen by rotating the rotating rotor and the screen in the opposite direction with each other, a circumferential velocity V (m/sec) of relative rotation of the rotating rotor to the screen satisfies an equation (1) below:

$$V=D\times\pi\times(N1+N2) \quad (1),$$

where D (m) is maximum outer diameter of the rotating rotor in the matching region, N1 (revolutions/sec) is number of rotations of the rotating rotor over a unit of time, N2 (revolutions/sec) is number of rotations of the screen over a unit of time, and a frequency Z (kHz) of the intermittent jet flow satisfies an equation (2) below:

$$Z=(N1+N2)\times X\times Y\div 1000 \quad (2),$$

where X is number of the plural blades, and Y is number of the plural slits, and the circumferential velocity V is set so as to be larger than 48 msec and smaller than 85 m/sec, and the frequency Z is set so as to be more than 65 kHz.

11. The stirrer according to claim 10, wherein the frequency Z is set at less than 185 kHz.

12. The stirrer according to claim 11, wherein diameters of the blades and of the screen become smaller as departing from an introduction port through which the fluid to be processed is introduced into the screen toward outside in the axial direction.

13. The stirrer according to claim 10, wherein diameters of the blades and of the screen become smaller as departing from an introduction port through which the fluid to be processed is introduced into the screen toward outside in the axial direction.

14. The stirrer according to claim 10, wherein a clearance between the screen and the blades is 0.2-2 mm.

15. The stirrer according to claim 10, wherein a number of the plural blades is no less than 6, a number of the plural slits is 30-150, and a maximum outer diameter of the rotating rotor in the matching region is in a range from 30 mm to 150 mm.

* * * * *